US007847762B2

(12) United States Patent
Iida et al.

(10) Patent No.: US 7,847,762 B2
(45) Date of Patent: Dec. 7, 2010

(54) DISPLAY DEVICE AND ELECTRONIC EQUIPMENT

(75) Inventors: Yukihito Iida, Kanagawa (JP); Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 803 days.

(21) Appl. No.: 11/878,515

(22) Filed: Jul. 25, 2007

(65) Prior Publication Data

US 2008/0030437 A1 Feb. 7, 2008

(30) Foreign Application Priority Data

Aug. 1, 2006 (JP) ..... P2006-209327

(51) Int. Cl.
*G09G 3/30* (2006.01)

(52) U.S. Cl. ..... 345/76; 345/80; 315/169.3

(58) Field of Classification Search ..... 345/55, 345/76–83, 92, 204, 206, 207, 211, 213, 345/690; 315/169.3; 313/500
See application file for complete search history.

(56) References Cited

U.S. PATENT DOCUMENTS

| | | | | |
|---|---|---|---|---|
| 7,429,985 | B2 * | 9/2008 | Kimura et al. | 345/213 |
| 7,646,363 | B2 * | 1/2010 | Yamashita et al. | 345/76 |
| 7,764,251 | B2 * | 7/2010 | Yamashita et al. | 345/76 |
| 2003/0179164 | A1 * | 9/2003 | Shin et al. | 345/76 |
| 2004/0246241 | A1 * | 12/2004 | Sato et al. | 345/204 |
| 2005/0012686 | A1 * | 1/2005 | Osame et al. | 345/39 |
| 2005/0206590 | A1 * | 9/2005 | Sasaki et al. | 345/76 |
| 2005/0269959 | A1 * | 12/2005 | Uchino et al. | 315/169.3 |
| 2006/0123293 | A1 * | 6/2006 | Kim et al. | 714/724 |
| 2006/0232574 | A1 * | 10/2006 | Miyazawa | 345/204 |
| 2006/0261864 | A1 * | 11/2006 | Miyazawa | 327/112 |

FOREIGN PATENT DOCUMENTS

| | | |
|---|---|---|
| JP | 2003-255856 | 9/2003 |
| JP | 2003-271095 | 9/2003 |

(Continued)

OTHER PUBLICATIONS

Japanese Office Action dated Jun. 3, 2008 for corresponding Japanese Application No. 2006-209327.

*Primary Examiner*—Amare Mengistu
*Assistant Examiner*—Dmitriy Bolotin
(74) *Attorney, Agent, or Firm*—Rader, Fishman & Grauer PLLC

(57) ABSTRACT

A display device is disclosed. The display device includes: a pixel array unit and a driving unit which drives the pixel array unit. The pixel array unit includes rows of scanning line, columns of signal lines, pixels in a matrix state arranged at portions where scanning lines and signal lines cross each other and power supply lines arranged corresponding to respective rows of pixels. The driving unit includes a main scanner performing line-sequential scanning to pixels by each row by supplying a control signal to each scanning line sequentially, a power supply scanner supplying a power supply voltage which is switched to a first potential and a second potential to each power supply line so as to correspond to the line-sequential scanning, and a signal selector supplying a signal potential and a reference potential to be video signal to columns of signal lines so as to correspond to the line-sequential scanning.

6 Claims, 24 Drawing Sheets

FOREIGN PATENT DOCUMENTS

| | | |
|---|---|---|
| JP | 2004-029791 | 1/2004 |
| JP | 2004-093682 | 3/2004 |
| JP | 2004-133240 | 4/2004 |
| JP | 2006-023515 | 1/2006 |
| JP | 2006-133542 | 5/2006 |

* cited by examiner

DISPLAY DEVICE AND ELECTRONIC EQUIPMENT

CROSS REFERENCES TO RELATED APPLICATIONS

The present invention contains subject matter related to Japanese Patent Application JP 2006-209327 filed in the Japanese Patent Office on Aug. 1, 2006, the entire contents of which being incorporated herein by reference.

BACKGROUND OF THE INVENTION

1. Field of the Invention

The invention relates to an active-matrix display device using light emitting elements in pixels. More particularly, the invention relates to a circuit configuration of a pixel including a sampling transistor, a driving transistor, and further a storage capacitor in addition to the light emitting element. Further particularly, the invention relates to a technology of improving write gain at the time of sampling a video signal in the storage capacitor. The invention also relates to electronic equipment in which such display device is incorporated therein.

2. Description of the Related Art

A planar self-light emitting display device using an organic EL device as the light emitting element has been extensively developed in recent years. The organic EL device is a device utilizing a phenomenon that an organic thin-film emits light when electric field is applied. Since the organic EL device is driven when an applied voltage is 10V or less, power consumption is low. In addition, since the organic EL device is a self-light emitting element which emits light by itself, lighting member is not necessary, as a result, it is easy to allow the device to be light and thin. Furthermore, since response speed of the organic EL device is extremely high such as approximately several μs, after-image at the time of displaying moving pictures does not occur.

Among the planar self-light emitting display devices using the organic EL devices in pixels, an active-matrix display device in which a thin-film transistor is formed at each pixel with integration as a driving element has been developed more extensively. The active-matrix planar self-light emitting display device is disclosed in, for example, JP-A-2003-255856, JP-A-2003-271095, JP-A-2004-133240, JP-A-2004-029791 and JP-A-2004-093682 (Patent Documents 1 to 5).

SUMMARY OF THE INVENTION

However, in the active-matrix planar self-light emitting display device in related arts, a threshold voltage and mobility of the transistor which drives light emitting element vary by process variations. In addition, characteristics of the organic EL device vary with time. Such characteristic variations of the driving transistor and characteristic variations of the organic EL device affect light emitting luminance. In order to control the light emitting luminance evenly over the whole screen of the display device, it is necessary to correct characteristic variations of the transistor and the organic EL device in each pixel circuit. The display devices including such correcting function at each pixel were proposed in related arts. However, wiring for supplying a potential for correction, a transistor for switching and a pulse for switching are necessary for the pixel circuit including the correction function in related arts, which complicates a configuration of the pixel circuit. Components of the pixel circuit are great in number, which prevents the definition of the display from being high.

It is desirable to provide a display device which enables the definition of the display to be high by simplifying the pixel circuit. Particularly, it is desirable to secure sampling gain of video signals in a simplified pixel circuit.

A display device according to an embodiment of the invention basically includes a pixel array unit and a driving unit which drives the pixel array unit. The pixel array unit includes rows of scanning line, columns of signal lines, pixels in a matrix state arranged at portions where scanning lines and signal lines cross each other and power supply lines arranged corresponding to respective rows of pixels. The driving unit includes a main scanner performing line-sequential scanning to pixels by each low by supplying a control signal to each scanning line sequentially, a power supply scanner supplying a power supply voltage which is switched to a first potential and a second potential to each power supply line so as to correspond to the line-sequential scanning, and a signal selector supplying a signal potential and a reference potential to be video signal to rows of signal lines so as to correspond to the line-sequential scanning. The pixel includes a light emitting element, a sampling transistor, a driving transistor and a storage capacitor. The sampling transistor is connected to the scanning line at a gate thereof, connected to the signal line at one of a source and a drain thereof, connected to a gate of the driving transistor at the other of the source and the drain, the driving transistor is connected to a light emitting element at one of a source and a drain thereof, and connected to the power supply line at the other of the source and the drain thereof and the storage capacitor is connected between the source and the gate of the driving transistor. In such display device, the sampling transistor is turned on according to the control signal supplied from the scanning line and samples the signal potential supplied from the signal line to be stored in the storage capacitor, and the driving transistor receives supply of current from the power supply line at the first potential and allows drive current to flow in the light emitting element according to the stored signal potential. The main scanner outputs the control signal to the scanning line at a timing of turning on the sampling transistor at a time slot when the signal line is at the signal potential, thereby writing the signal potential in the storage capacitor, as well as adds a correction to the signal potential, which is for mobility of the driving transistor. As a feature point, the pixel includes an auxiliary capacitor in order to increase write gain when storing the signal potential in the storage capacitor and in order to adjust time necessary for the correction of mobility.

Specifically, the auxiliary capacitor is connected to the source of the driving transistor at one end thereof and connected to another power supply line belonging to a previous row from the power supply line of the relevant row at the other end thereof. It is preferable that the main scanner turns off the sampling transistor and electrically disconnects the gate of the driving transistor from the signal line when the signal potential is stored in the storage capacitor, thereby allowing a gate potential to interlock with variations of a source potential of the driving transistor to maintain a voltage between the gate and the source to be constant. The main scanner outputs a control signal for turning on the sampling transistor at a time slot when the power supply line is at the first potential as well as the signal line is at the reference potential to perform a threshold voltage correction operation for storing a voltage corresponding to a threshold voltage of the driving transistor in the storage capacitor.

The display device according to an embodiment of the invention includes a threshold voltage correction function, a mobility correction function, a bootstrap function and the like at each pixel. According to the threshold voltage correction function, threshold voltage variations of the driving transistor can be corrected. In addition, according to the mobility correction function, mobility variation of the driving transistor can be also corrected. According to bootstrap operation of the storage capacitor at the time of emitting light, a regularly constant light emitting luminance can be maintained, regardless of characteristic variation of the organic EL device. That is, even when current/voltage characteristics of the organic EL device vary with time, a voltage between gate/source of the driving transistor is maintained to be constant by the bootstrapped storage capacitor, therefore, the light emitting luminance can be maintained to be constant.

According to an embodiment of the invention, the threshold voltage correction function, the mobility correction function, the bootstrap function and the like are incorporated in each pixel, therefore, a power supply voltage to be supplied to each pixel is used as a switching pulse. By allowing the power supply voltage to be the switching pulse, a switching transistor for correcting a threshold voltage and a scanning line for controlling the gate are not necessary. As a result, components and wiring of a pixel circuit can be drastically reduced and a pixel area can be reduced, which realizes high definition of the display. Since the pixel circuit of the related arts which has the above functions have the great number of components, a layout area becomes large and the circuit is not adequate to the high definition of the display. However, in the embodiment of the invention, the number of components and the number of wiring are reduced by switching the power supply voltage, as a result, the layout area of pixels can be reduced.

As the fineness of pixels is proceeding, a capacitance value of the storage capacitor which samples the signal potential of the video signal decreases. Writing gain of the signal potential is reduced by being affected by wiring capacitance and parasitic capacitance. In the embodiment of invention, an auxiliary capacitor is formed in addition to the storage capacitor at each pixel to increase write gain at the time of storing the signal potential in the storage capacitor. In addition, time necessary for correcting mobility can be adjusted by providing the auxiliary capacitor. Accordingly, when driving of the pixel array is performed at high speed, correction of mobility can be sufficiently performed. At that time, one end of the auxiliary capacitor is connected to the source of the driving transistor, and the other end is connected to another power supply line which belongs to a previous row from the power supply line of the relevant row. Accordingly, the threshold voltage correction function of each pixel circuit can be normally performed without receiving potential variations of the power supply line. The auxiliary capacitor is formed between the source and the power supply line of the previous stage, thereby positively performing the threshold voltage correction operation and obtaining the good picture quality.

DESCRIPTION OF THE PREFERRED EMBODIMENTS

Figure 1:
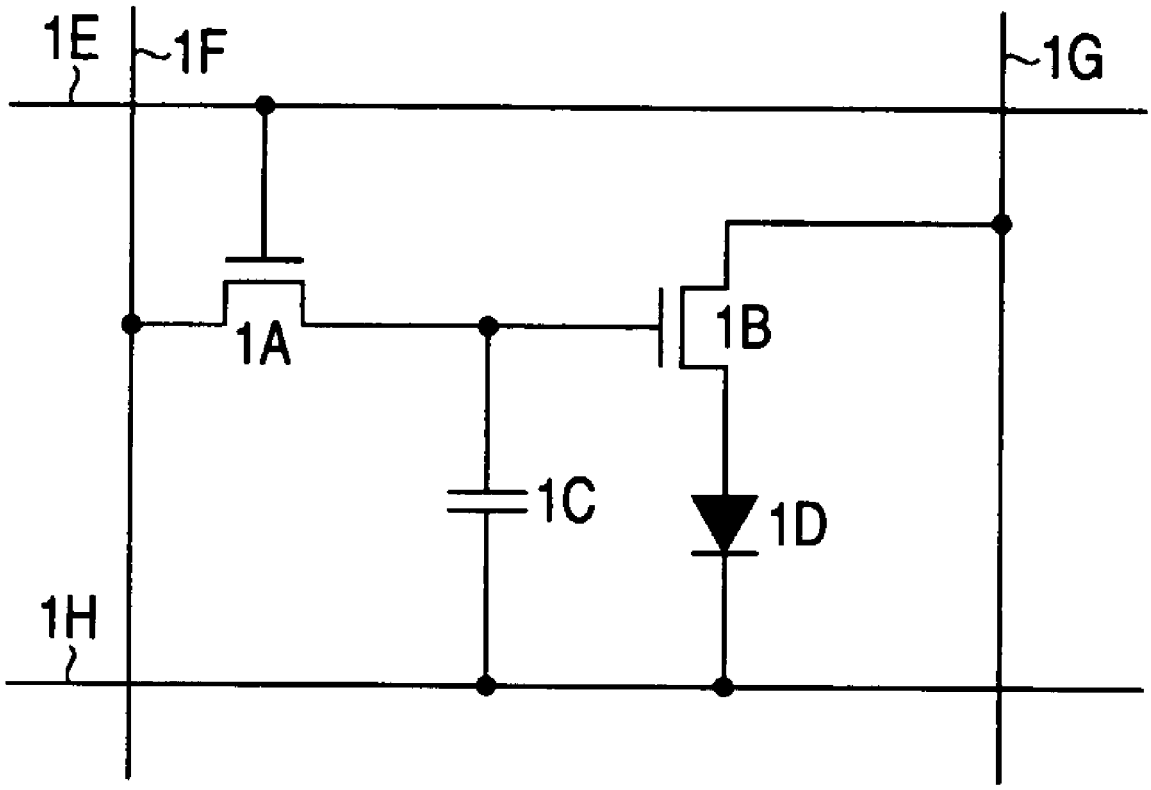
FIG. 1 is a circuit diagram showing a general circuit configuration.

Hereinafter, an embodiment of the invention will be explained in detail with reference to the drawings. First, in order to make the invention easy to comprehend and clarify the background, general configuration of a display device will be briefly explained with reference to FIG. 1. FIG. 1 is a schematic circuit diagram showing a pixel of a general display device. As shown in the drawing, a sampling transistor 1A is arranged at an intersection of a scanning line 1E and a signal line 1F which are arranged so as to be orthogonal to each other in the pixel circuit. The sampling transistor 1A is an N-type, and a gate of which is connected to the scanning line 1E and a drain of which is connected to the signal line 1F. One electrode of a storage capacitor 1C and a gate of a driving transistor 1B are connected to a source of the sampling transistor 1A. The driving transistor 1B is an N-type, and a drain of which is connected to a power supply line 1G and a source of which is connected to an anode of a light emitting element 1D. The other electrode of the storage capacitor 1C and a cathode of the light emitting element 1D are connected to a ground wiring 1H.

Figure 2:
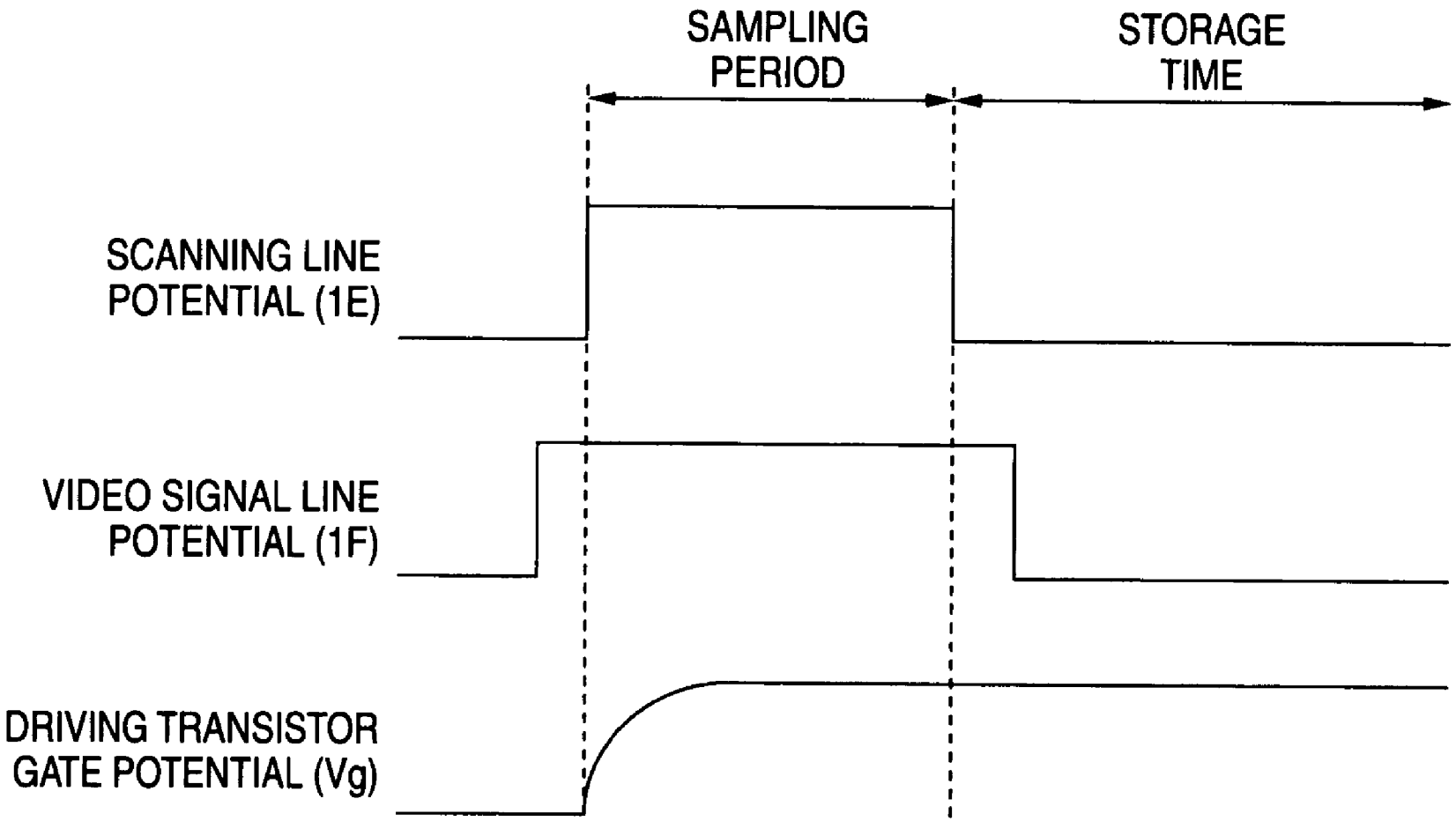
FIG. 2 is a timing chart used for explaining operation of a pixel circuit shown in FIG. 1.

FIG. 2 is a timing chart used for explaining operation of the pixel circuit shown in FIG. 1. The timing chart indicates operation of sampling a potential (video signal line potential) of a video signal supplied from the signal line (1F) and allowing the light emitting element 1D including an organic EL device and the like to emit light. When a potential (scanning line potential) of the scanning line (1E) makes a transition to a high level, the sampling transistor (1A) is turned on and charges the video signal line potential to the storage capacity (1C). According to this, a gate potential (Vg) of the drive transistor (1B) starts increasing and drain current starts flowing. Therefore, an anode potential of the light emitting element (1D) increases and starts emitting light. After that, when the scanning line potential makes a transition to a low level, the video signal line potential is stored in the storage capacitor (1C), the gate potential of the driving transistor (1B) is fixed and the light emitting luminance is maintained to be constant until a next frame.

However, according to variations of manufacturing processes of the driving transistor (1B), there are characteristic variations such as a threshold voltage or mobility at each pixel. Due to the characteristic variations, even when the same gate potential is given to the driving transistor (1B), drain current (drive current) varies at each pixel, which appears as variations of light emitting luminance. Also due to variations with time in characteristics of the light emitting element (1D) including the organic EL device and the like, the anode potential of the light emitting element (1D) varies. The variations of the anode potential appears as voltage variations between the gate and the source of the driving transistor (1B), which causes variations of drain current (drive current). The variations of drive current due to various causes appear as variations of light emitting luminance at each pixel, which causes deterioration of picture quality.

Figure 3A:
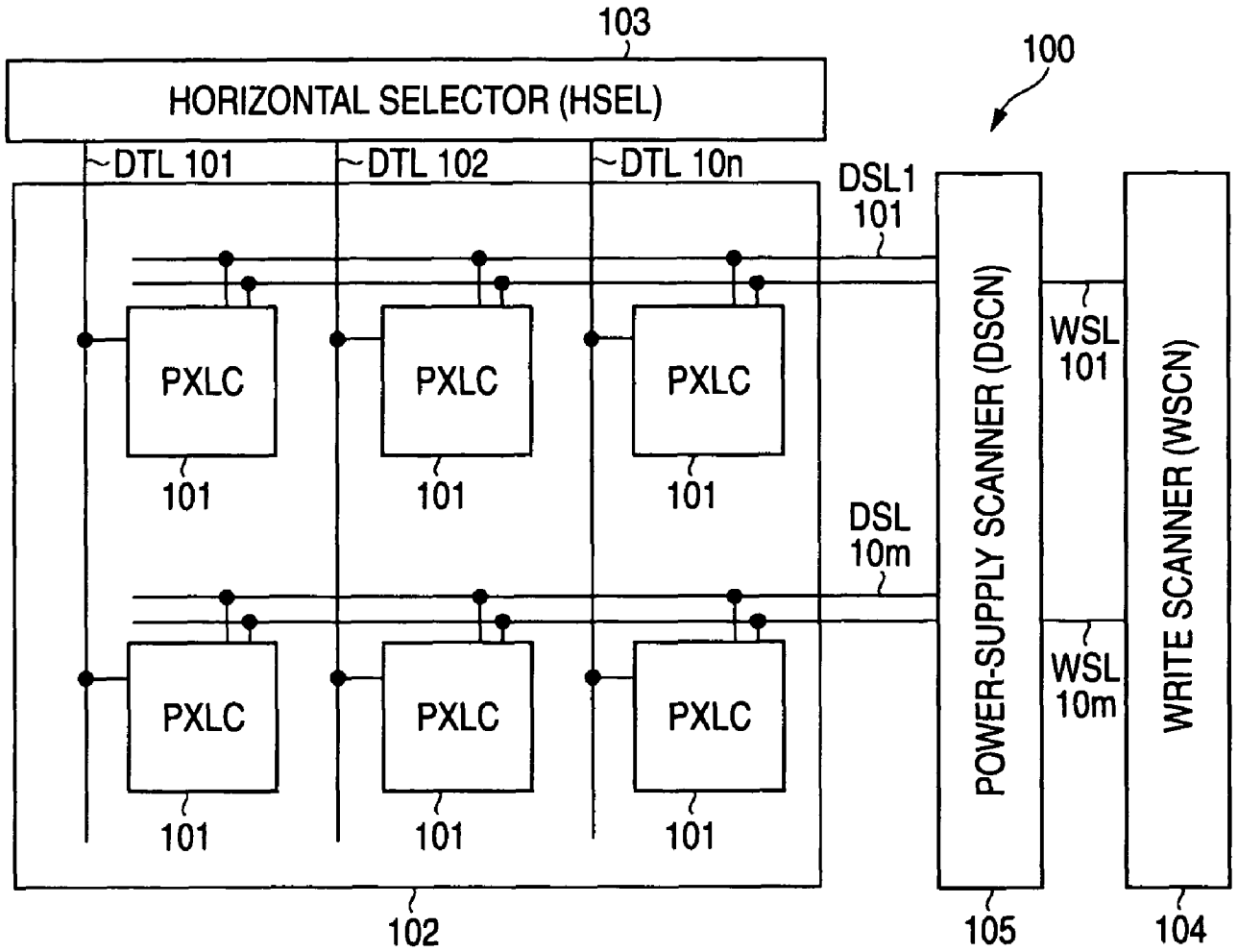
FIG. 3A is a block diagram showing the whole configuration of a display device according to a precedent development.

FIG. 3A is a block diagram showing the whole configuration of a display device according to a precedent development as a source of the invention. Since the display device has a lot of common components as the display device according to an embodiment of the invention, the display device according to the precedent development will be explained in detail as part of explanation of the embodiment the invention hereinafter. As shown in the drawing, a display device 100 according to the precedent development basically includes a pixel array unit 102 and driving units (103, 104 and 105) which drive the pixel array unit 102. The pixel array unit 102 includes scanning lines WSL101 to WSL 10*m* in rows, signal lines DTL101 to DTL10*n* in columns, pixels (PXLC) 101 in a matrix state arranged at portions where scanning lines and signal lines cross each other and power supply lines DSL101 to DSL 10*m* arranged corresponding to respective rows of respective pixels 101. The driving units (103, 104 and 105) includes a main scanner (write scanner WSCN) 104 which sequentially supplies control signals to respective scanning lines WSL101 to 10*m* at a horizontal cycle (1H) and performs line-sequential scanning to pixels 101 by each row, a power supply scanner (DSCN) 105 which supplies power supply voltage switched to a first voltage and a second voltage to respective power supply lines DSL101 to 10*m* so as to correspond to the line-sequential scanning and a signal selector (horizontal selector HSEL) 103 which switches the signal potential and a reference potential to be a video signal in each horizontal period (1H) so as to correspond to the line-sequential scanning to supply the voltage to signal lines DTL101 to 10*m* in columns.

Figure 3B:
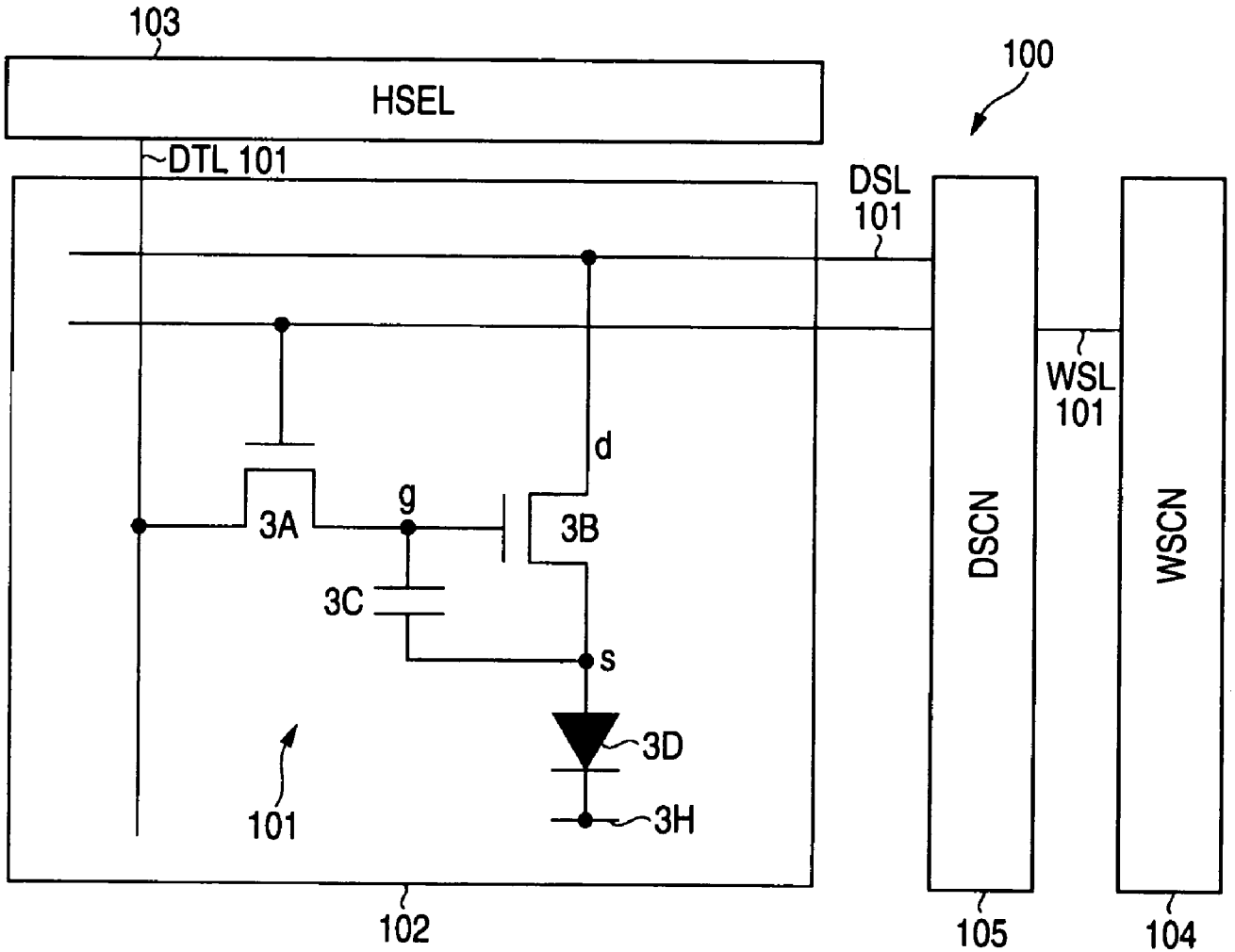
FIG. 3B is a circuit diagram showing a circuit configuration of the display device according to the development.

FIG. 3B is a circuit diagram showing a specific configuration and wire connection relation of a pixel 101 included in the display device 100 shown in FIG. 3A. As shown in the drawing, the pixel 101 includes a light emitting element 3D which is represented by an organic EL device and the like, a sampling transistor 3A, a driving transistor 3B and a storage capacitor 3C. In the sampling transistor 3A, a gate of which is connected to the scanning line WSL101, one of a source and a drain of which is connected to the corresponding signal line DTL101, and the other of which is connected to a gate "g" of the driving transistor 3B. In the driving transistor 3B, one of a source "s" and a drain "d" is connected to the light emitting element 3D and the other of which is connected to the corresponding power source line DSL101. In the embodiment, the drain "d" of the driving transistor 3B is connected to the power source line DSL101 and the source "s" is connected to an anode of the light emitting element 3D. A cathode of the light emitting element 3D is connected to a ground wiring 3H. The ground wiring 3H is arranged to all pixels 101 in common. The storage capacitor 3C is connected between the source "s" and the gate "g" of the driving transistor 3B.

In the above configuration, the sampling transistor 3A is turned on according to a control signal supplied from the scanning line WSL101 and samples a signal potential supplied from the signal line DTL101 to store it in the storage capacitor 3C. The driving transistor 3B receives supply of current from the power supply line DSL101 which is in the first potential and allows drive current to flow in the light emitting element 3D according to the signal potential stored in the storage capacitor 3C. The main scanner 104 outputs the control signal for turning on the sampling transistor 3A at a time slot when the power supply line DSL101 is at the first potential as well as the signal line DTL101 is at the reference potential and performs a threshold voltage correction operation for storing a voltage corresponding to a threshold voltage Vth of the driving transistor 3B in the storage capacitor 3C. The main scanner 104 stores the voltage corresponding to the threshold voltage Vth of the driving transistor 3B positively in the storage capacitor Cs by repeatedly performing the threshold voltage correction operation at plural horizontal periods precedent to the sampling of the signal potential. Sufficient long writing time is secured by performing threshold voltage correction operation plural times, therefore, the voltage corresponding to the threshold voltage of the driving transistor can be positively stored in the storage capacitor 3C in advance. The stored threshold voltage is used for canceling the threshold voltage of the driving transistor. Therefore, even when the threshold voltage of the driving transistor varies at each pixel, it will be completely cancelled by each pixel, which increases uniformity of pictures. Particularly, luminance unevenness which tends to occur especially when the signal potential is in low gradation level can be prevented.

The main scanner 104 outputs the control signal at a time slot when the power supply line DSL101 is at the second potential as well as the signal line DTL101 is at the reference potential before the threshold voltage correction operation to turn on the sampling transistor 3A, thereby setting the gate "g" of the driving transistor 3B to the reference potential as well as setting the source "s" to the second potential. According to the reset operation of the gate potential and the source potential, succeeding threshold voltage correction operation can be positively performed.

The pixel 101 shown FIG. 3B includes a mobility correction function in addition to the threshold voltage correction function. In order to turn on the sampling transistor 3A at a time slot when the signal line DTL101 is at the signal potential, the main scanner 104 outputs a control signal having shorter pulse width than the above time slot in the scanning line WSL101, thereby adding correction for a mobility; of the driving transistor 3B to the signal potential at the same time as when storing the signal potential in the storage capacity 3C.

The pixel circuit 101 shown in FIG. 3B further includes a bootstrap function. That is, the main scanner (WSCN) 104 cancels application of the control signal to the scanning line WSL101 at a stage when the signal potential is stored in the storage capacitor 3C, turns off the sampling transistor 3A to electrically disconnects the gate "g" of the driving transistor 3B from the signal line DTL101, accordingly, a gate potential (Vg) is interlocked with the variation of a source potential (Vs) of the driving transistor 3B and a voltage Vgs between the gate "g" and the source "s" can be maintained to be constant.

Figure 4A:
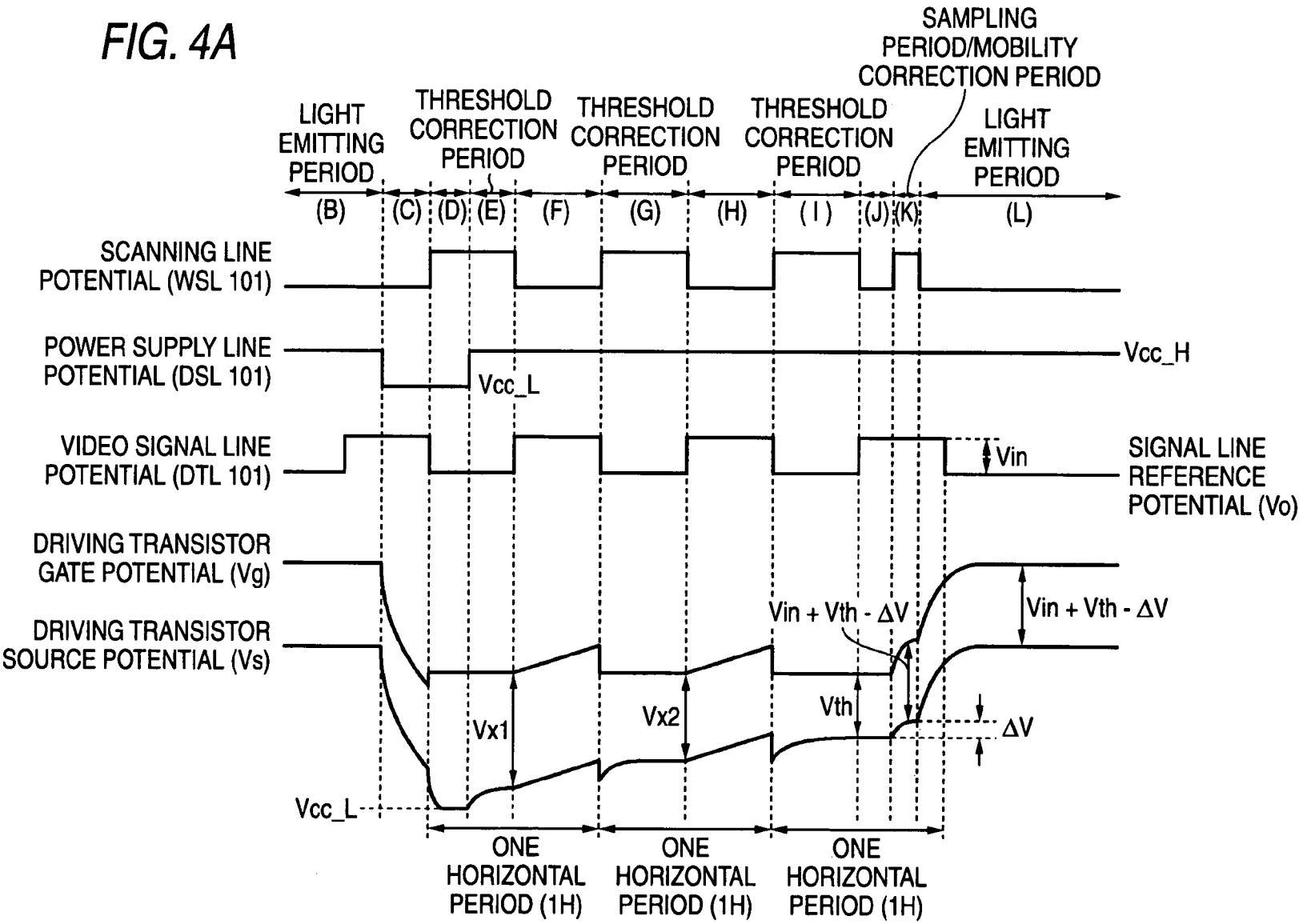
FIG. 4A is a timing chart for explaining operation of the precedent development example shown in FIG. 3B.

FIG. 4A is a timing chart used for explaining operation of the pixel 101 shown in FIG. 3B. Potential variation of the scanning line (WSL101), potential variations of the power supply line (DSL101) and potential variations of the signal line (DTL101) are shown, taking a time axis as common. In addition, variations of the gate potential (Vg) and the source potential (Vs) of the driving transistor 3B are also shown in parallel with these potential variations.

In the timing chart, periods are divided into B to L so as to correspond to transition of operation of the pixel 101 such as periods B to L for convenience. In a light emitting period B, a light emitting element 3D is in a light emitting state. After that, at the first period C when entering into a new field of the line sequential scanning, the power supply line DSL101 switches from a high potential (Vcc_H) to a low potential (Vcc_L). Subsequently, at a preparation period D, the gate potential Vg of the driving transistor 3B is reset to a reference potential Vo as well as the source potential Vs is reset to the low potential Vcc_L of the power supply line DTL101. Subsequently, the first threshold voltage correction operation is performed in the first threshold correction period E. Since the time width is short for one period, a voltage to be written in the storage capacitor 3C is Vx1, which does not reach the threshold voltage Vth of the driving transistor 3B.

Subsequently, after a passing period F, the operation proceeds to the second threshold voltage correction period (G) at a next one horizontal period (1H). The second threshold voltage correction operation is performed here, and a voltage Vx2 written in the storage capacitor 3C comes close to Vth. Furthermore, after a passing period H, the operation enters the third threshold voltage correction period (I) at a next horizontal period (1H), where the third threshold voltage correction operation is performed. According to this, a voltage written in the storage capacitor 3C reaches the threshold voltage Vth of the driving transistor 3B.

At a latter half of the last one horizontal period, the video signal line DTL101 rises from the reference voltage Vo to a signal voltage Vin. After a period J, the signal voltage Vin of the video signal is written in the storage capacitor 3C in a form that the voltage is added to Vth at a sampling period/mobility correction period (K) as well as a voltage ΔV for correcting mobility is subtracted from the voltage stored in the storage capacitor 3C. After that, the operation proceeds to a light emitting period L, and the light emitting element emits light at the luminance according to the signal voltage Vin. At that time, the signal voltage Vin is adjusted by the voltage corresponding to the threshold voltage Vth and the voltage ΔV for correcting mobility, therefore, the light emitting luminance of the light emitting element 3D is not affected by variations of the threshold voltage Vth and the mobility μ of the driving transistor 3B. At the beginning of the light emitting period L, a boot strap operation is performed, and the gate voltage Vg and the source voltage Vs of the driving transistor 3B rise while the voltage between gate/source of the driving transistor 3B Vgs=Vin+Vth−ΔV is maintained to be constant.

The driving method shown in FIG. 4A is the case in which the threshold voltage correction operation is repeated three times, and the threshold voltage correction operation is performed at the periods (E), (G), and (I). The periods (E), (G), and (I) belong to the first half time slot of each horizontal period (1H), and during these periods, the signal line DTL101 is at the reference voltage Vo. In these periods, the scanning line WSL101 is switched to the high level, and the sampling transistor 3A is turned on. Accordingly, the gate potential Vg of the driving transistor 3B becomes the reference potential Vo. In these periods, the threshold voltage correction operation of the driving transistor 3B is performed. The latter half of each horizontal period (1H) is a sampling period of the signal potential for pixels of other rows. Therefore, in the periods F and H, the scanning line WSL101 is switched to the low level and the sampling transistor 3A is turned off. By repeating such operation, the voltage Vgs between gate/source of the driving transistor 3B reaches the threshold voltage Vth of the driving transistor 3B soon. The number of repeating times of the threshold voltage correction operation is set to the optimum number of times depending on the circuit configuration of the pixel and the like, thereby positively performing the threshold voltage correction operation. Accordingly, good picture quality can be obtained at any gradation from the low gradation of a black level to the high gradation of a white level.

Figure 4B:
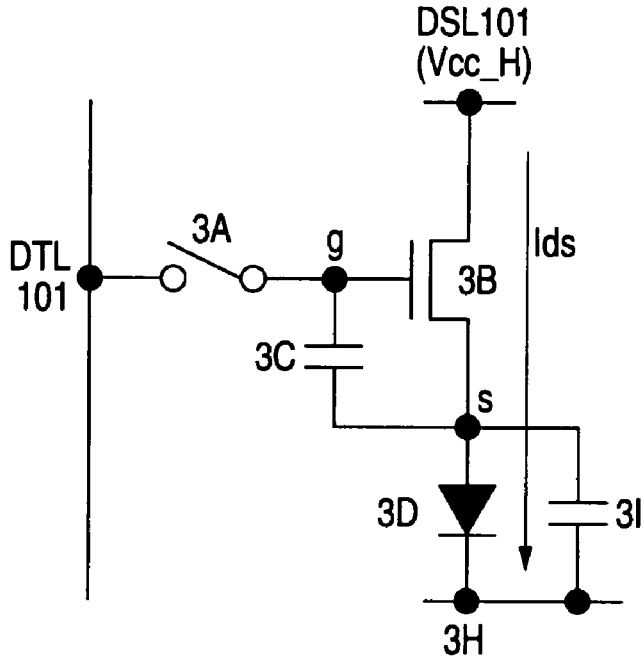
FIG. 4B is a circuit diagram for explaining operation in the same manner.

With reference to FIG. 4B to FIG. 4L continuously, the operation of the pixel 101 shown in FIG. 3B will be explained in detail. The numbers of drawings of FIG. 4B to FIG. 4L correspond to respective periods B to L in the timing chart shown in FIG. 4A. For easy comprehension, in FIG. 4B to FIG. 4L, a capacitive component of the light emitting element 3D is shown as a capacitor element 3I for convenience of explanation. As shown in FIG. 4B, in the light emitting period B, the power supply line DSL101 is at the high potential Vcc_H (first potential) and the driving transistor 3B supplies a drive current Ids in the light emitting element 3D. As shown in the drawing, the drive current Ids passes the light emitting element 3D from the power supply line DSL101 at the high potential Vcc_H through the driving transistor 3B to flow into the common ground wiring 3H.

Figure 4C:
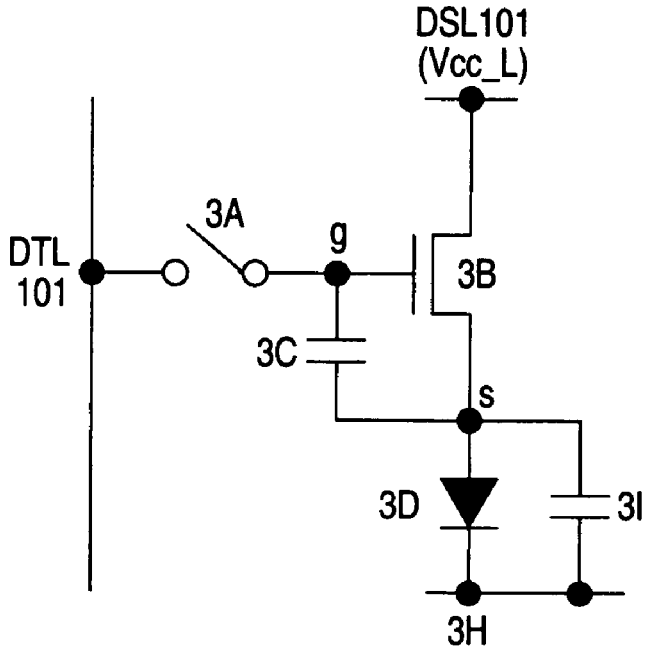
FIG. 4C is a circuit diagram for explaining operation in the same manner.

Subsequently, when entering the period C, as shown in FIG. 4C, the power supply line DSL101 is switched to the low potential Vcc_L from the high potential Vcc_H. Accordingly, the power supply line DSL101 is discharged to be Vcc_L, and the source potential Vs of the driving transistor 3B makes a transition to a potential close to Vcc_L. When wiring capacitance of the power supply line DSL101 is large, it is preferable that the power supply line DSL101 is switched to the low potential Vcc_L from the high potential Vcc_H at a timing relatively early. By sufficiently securing the period C, effect by wiring capacitance or other pixel parasitic capacitance is prevented.

Figure 4D:
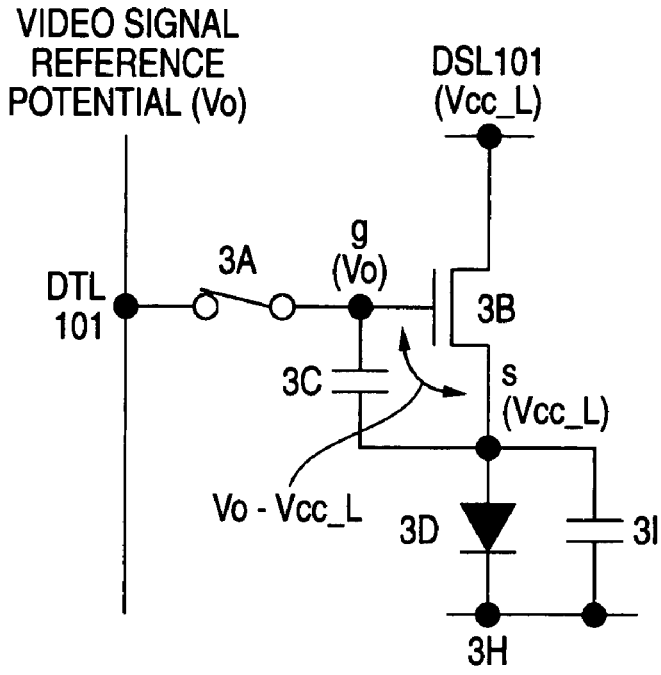
FIG. 4D is a circuit diagram for explaining operation in the same manner.

Next, when the operation proceeds to the period D, as shown in FIG. 4D, the scanning line WSL101 is switched from the low level to the high level, thereby making the sampling transistor 3A to be conductive. At this time, the video signal line DTL101 is at the reference potential Vo. Therefore, the gate potential Vg of the driving transistor 3B becomes the reference potential Vo of the video signal line DTL101 through the sampling transistor 3A. At the same time, the source potential Vs of the driving transistor 3B is fixed to the low potential Vcc_L immediately. Accordingly, the source potential Vs of the driving transistor 3B is reset to the potential Vcc_L which is sufficiently lower than the reference potential Vo of the video signal line DTL. Specifically, the low potential Vcc_L (second potential) of the power supply line DSL101 is set so that the voltage Vgs between gate/source of the driving transistor 3B (difference between the potential Vg and the source potential Vs) is larger than the threshold voltage Vth of the driving transistor 3B.

Figure 4E:
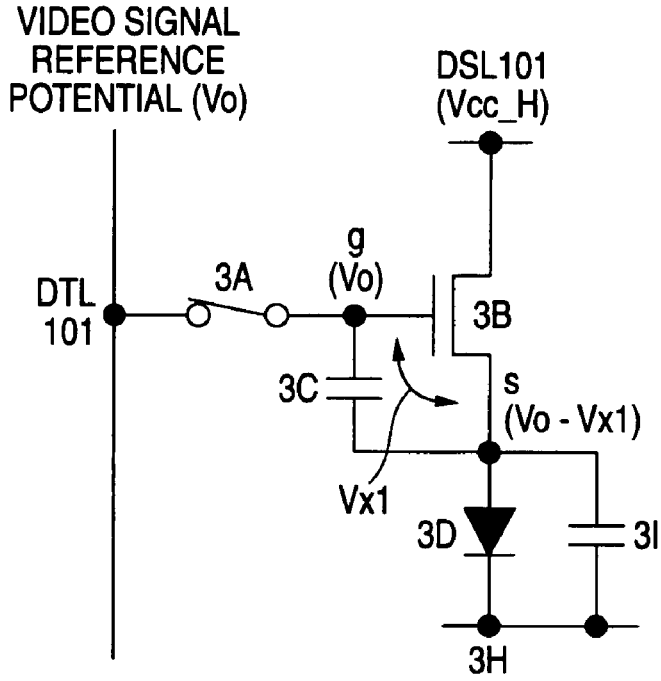
FIG. 4E is a circuit diagram for explaining operation in the same manner.

Next, when the operation proceeds to the first threshold correction period E, as shown in FIG. 4E, a potential of the power supply line DSL101 makes a transition from the low potential Vcc_L to the high potential Vcc_H, and the source potential Vs of the driving transistor 3B starts increasing. The period E ends at a point that the source potential Vs becomes Vx1 from Vcc_L. Therefore, Vx1 is written in the storage capacitor 3C in the first threshold correction period E.

Figure 4F:
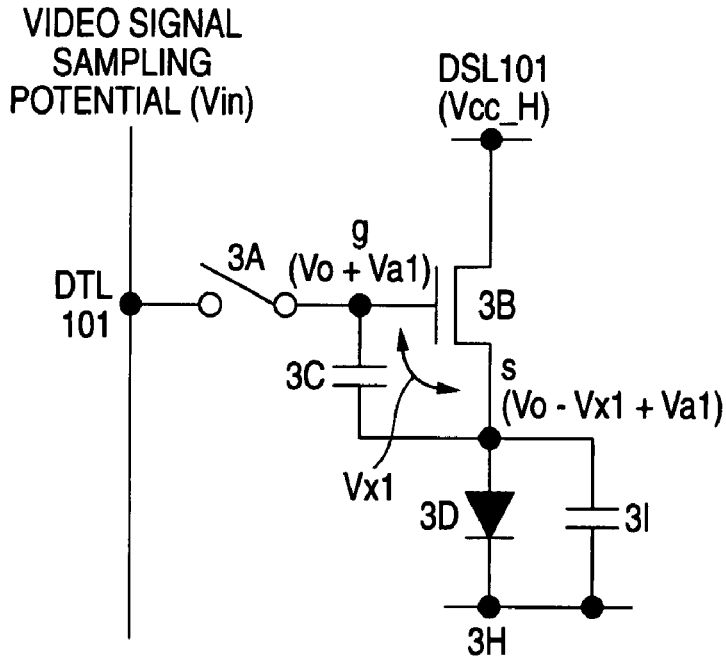
FIG. 4F is a circuit diagram for explaining operation in the same manner.

Subsequently, at a latter half period (F) of the horizontal cycle (1H), as shown in FIG. 4F, the video signal line varies to the signal potential Vin, whereas the scanning line WSL101 becomes low in level. The period F is the sampling period of the signal potential Vin for pixels of other rows, and it is necessary to turn off the sampling transistor 3A of this pixel.

Figure 4G:
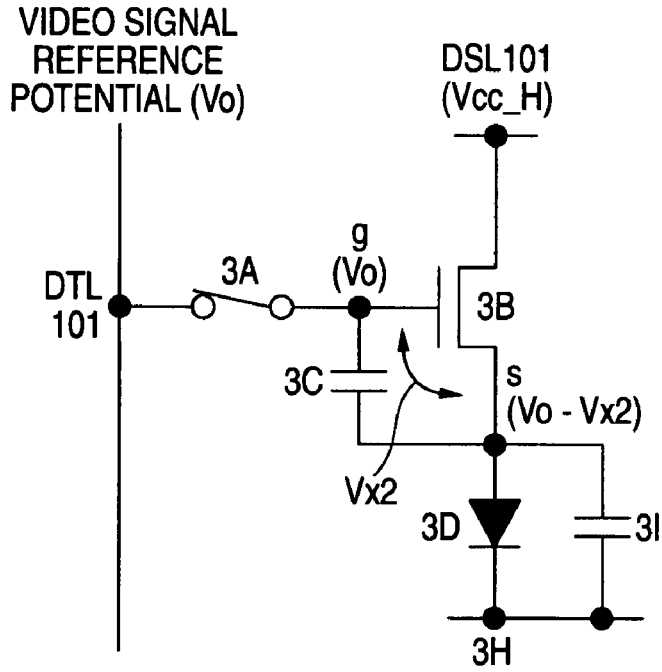
FIG. 4G is a circuit diagram for explaining operation in the same manner.

At the first half of the next one horizontal cycle (1H), the operation proceeds to the threshold correction period G again, and the second threshold voltage correction operation is performed as shown in FIG. 4G. The video signal line DTL101 is at the reference potential Vo, the scanning line WSL101 becomes high in level and the sampling transistor 3A is turned on in the same manner as the first time. According to the operation, potential writing for the storage capacitor 3C proceeds and reaches Vx2.

Figure 4H:
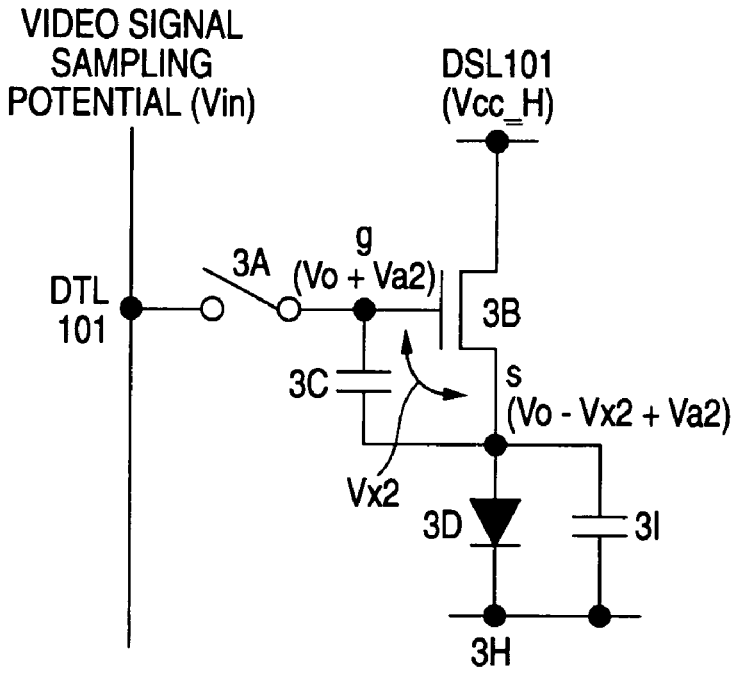
FIG. 4H is a circuit diagram for explaining operation in the same manner.

At the latter half H of the horizontal cycle (1H), as shown in FIG. 4H, the scanning line WSL101 of the relevant row becomes low in level and the sampling transistor 3A is turned off in order to sample the signal potential for pixels of other rows.

Figure 4I:
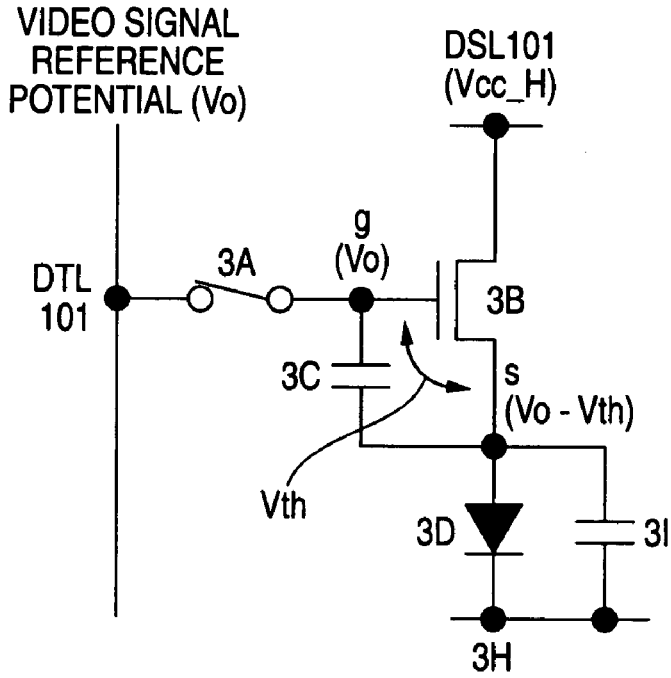
FIG. 4I is a circuit diagram for explaining operation in the same manner.

Next, the operation proceeds to the third threshold correction period I, as shown in FIG. 4I, the scanning line WSL101 is switched to the high level, the sampling transistor 3A is turned on, and the source potential Vs of the driving transistor 3B starts increasing. Then, current is cut off at a point where the voltage Vgs between gate/source of the driving transistor 3B becomes just threshold voltage Vth. Accordingly, the voltage corresponding to the threshold voltage Vth of the driving transistor 3B is written in the storage capacitor 3C. In three threshold correction periods E, G and I, a potential of the common ground wiring 3H is set so that the light emitting element 3D is cut off for allowing drive current to flow almost in side of the storage capacity 3C, not to flow in the side of light emitting element 3D.

Figure 4J:
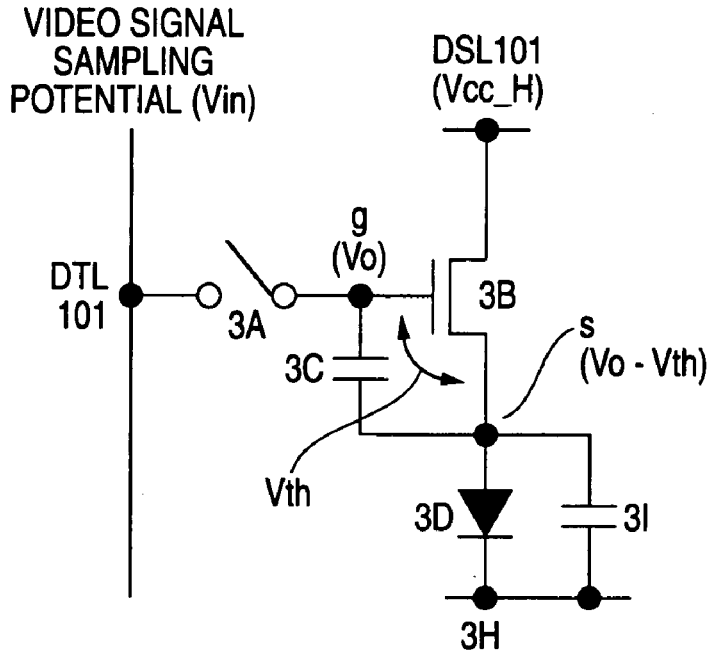
FIG. 4J is a circuit diagram for explaining operation in the same manner.

Subsequently, the operation proceed to the period J, as shown in FIG. 4J, the potential of the video signal line DTL101 makes a transition from the reference potential Vo to the sampling potential (signal potential) Vin. Accordingly, preparation for next sampling operation and mobility correction operation is completed.

Figure 4K:
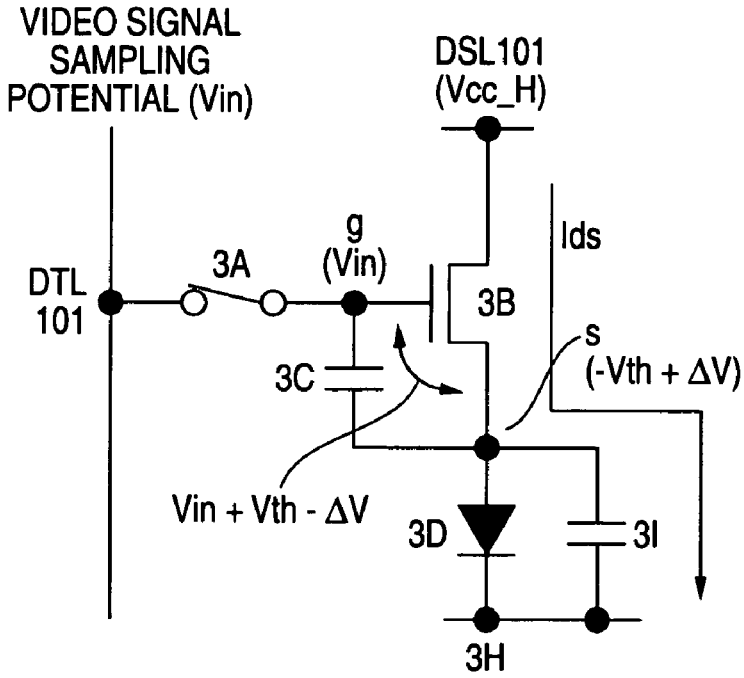
FIG. 4K is a circuit diagram for explaining operation in the same manner.

When entering the sampling period/mobility correction period K, as shown in FIG. 4K, the scanning line WSL101 makes a transition to the side of high level and the sampling transistor 3A is turned on. Therefore, the gate potential Vg of the driving transistor 3B becomes the signal potential Vin. Since the light emitting element 3D is in the cut-off state (high impedance state) at the beginning, the current Ids between drain/source of the driving transistor 3B flows in the light emitting element capacitor 3I to start charging light. Therefore, the source potential Vs of the driving transistor 3B starts increasing, then, the voltage Vgs between gate/source of the driving transistor 3B becomes Vin+Vth−ΔV. Accordingly, sampling of the signal potential Vin and adjustment of a correction amount ΔV are performed at the same time. The higher the Vin is, the larger the Ids becomes, and the larger an absolute value of ΔV becomes. Therefore, mobility correction according to the light emitting luminance level is performed. When the Vin is fixed, the larger the mobility μ of the driving transistor 3B, the larger the absolute value of ΔV becomes. In other words, the larger the mobility μ is, the larger a negative feedback amount ΔV becomes, as a result, variations of the mobility μ at each pixel can be removed.

Figure 4L:
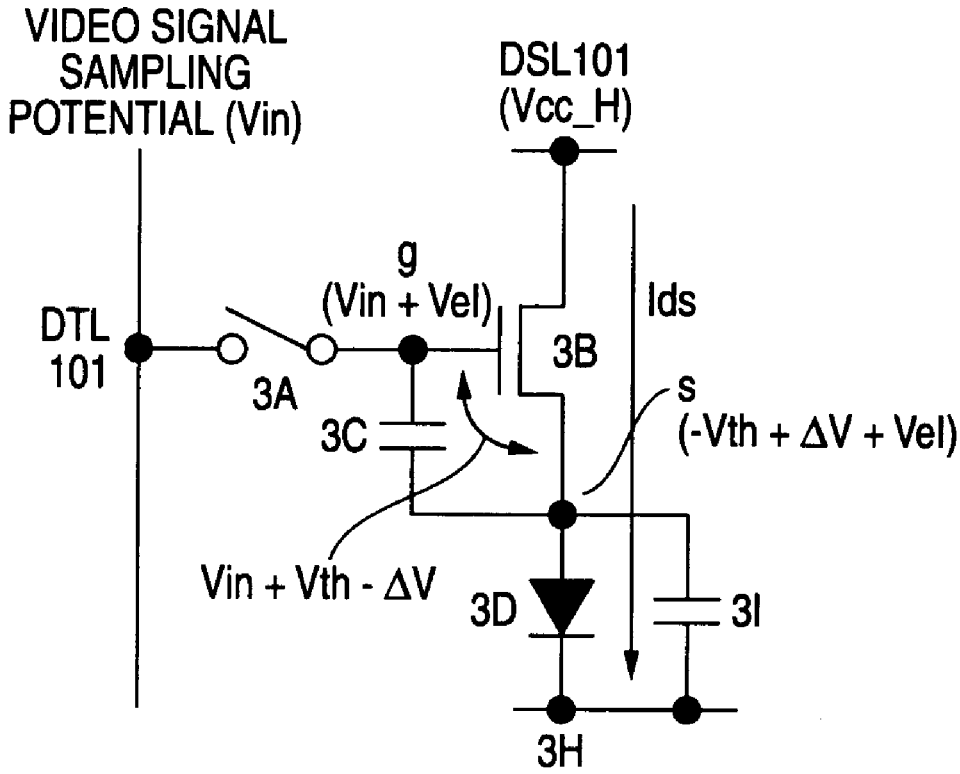
FIG. 4L is a circuit diagram for explaining operation in the same manner.

Lastly, at the light-emitting period L, as shown in FIG. 4L, the scanning line WSL101 makes a transition to the side of the low potential and the sampling transistor 3A turns off. Accordingly, the gate "g" of the driving transistor 3B is disconnected from the signal line DTL101. At the same time, the drain current Ids start flowing in the light emitting element 3D. Accordingly, the anode potential of the light emitting element 3D rises for Vel in accordance with the drive current Ids. The elevation of the anode potential of the light emitting element 3D is nothing but the elevation of the source potential Vs of the driving transistor 3B. When the source potential Vs of the driving transistor 3B rises, the gate potential Vg of the driving transistor 3B rises in conjunction with that by the bootstrap operation of the storage capacitor 3C. An elevation amount Vel of the gate potential Vg becomes equivalent with the elevation amount Vel of the source potential Vs. Therefore, the voltage Vgs between gate/source of the driving transistor 3B is maintained to be constant at Vin+Vth−ΔV during the light emitting period.

In the display device according to the precedent development shown in FIG. 3B, one pixel includes the light emitting element 3D, the sampling transistor 3A, the driving transistor 3B and the storage capacitor 3C, configuration of which is extremely simplified. In addition, wiring is also simplified, that is, only four wiring are basically necessary, which are the signal line DTL, the scanning line WSL, the power supply line DSL and the ground wiring. As described above, through the pixel configuration is simplified, the configuration includes the threshold voltage correction function, the mobility correction function and the bootstrap function, in which the luminance of the light emitting element can be controlled accurately in accordance with the gradation of the inputted video signal.

Figure 5:
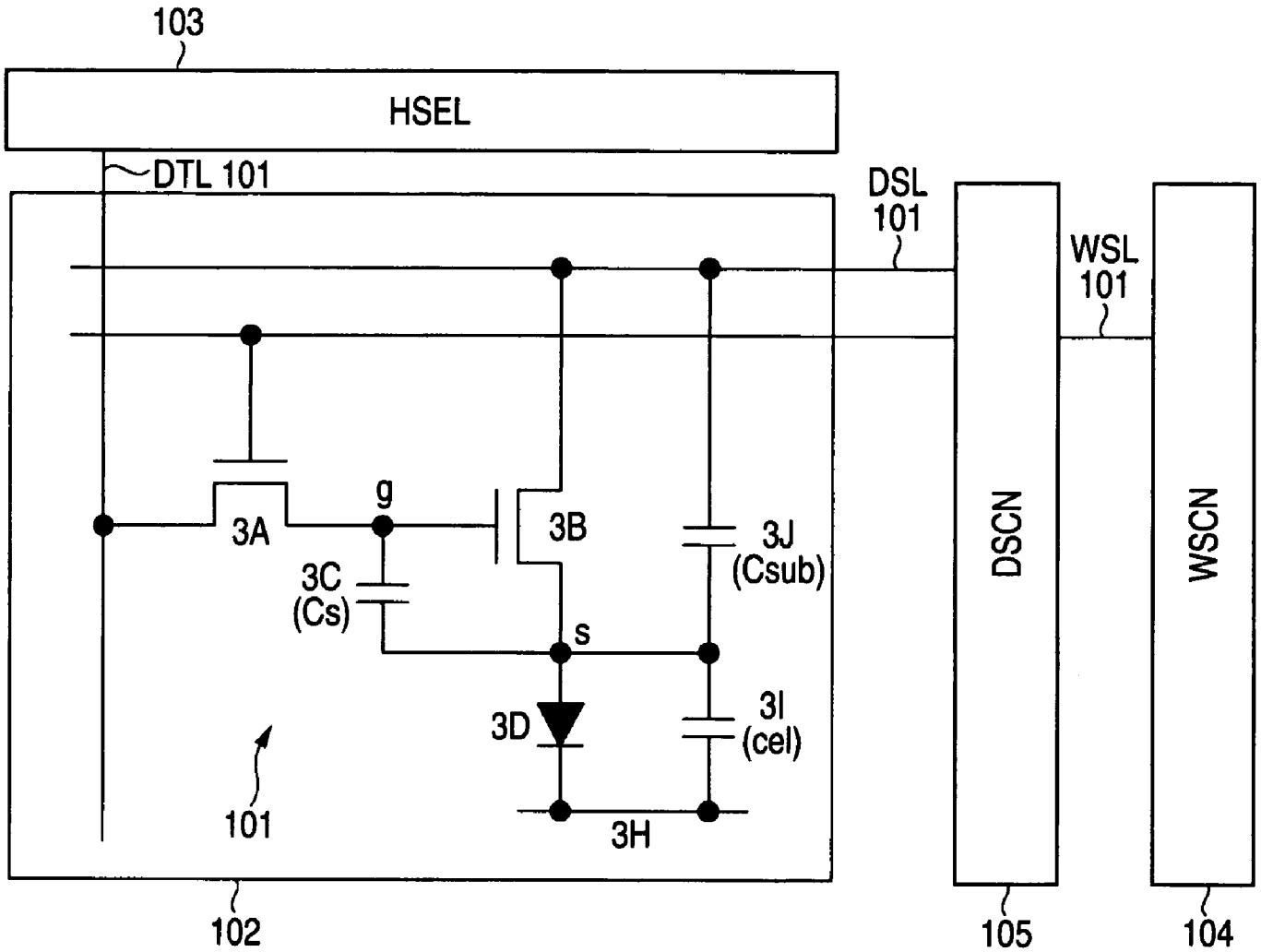
FIG. 5 is a circuit diagram showing a display device according to another precedent development.

However, as miniaturization of pixels is proceeding, a capacitance value of the storage capacitor naturally decreases, and the write gain of the signal potential with respect to the storage capacitor decreases by being affected by the wiring capacitance and the parasitic capacitance. In order to compensate the lowering of the write gain, an auxiliary capacitor is used. FIG. 5 is a schematic circuit diagram showing a display device according to another precedent development which was a source of the invention. For easy comprehension, corresponding reference numerals are put to components corresponding to the first example of the precedent development shown in FIG. 3B. A different point is that the second example of the precedent development includes an auxiliary capacitor 3J. In the drawing, a capacitance value of the auxiliary capacitor 3J is denoted by Csub. The capacitance value of the storage capacitor 3C is denoted by Cs, and the capacitance value of the equivalent capacitor 3I of the light emitting element 3D is denoted by Cel. As shown in the drawing, the auxiliary capacitor 3J is connected between the source "s" of the driving transistor 3B and the power supply line DSL101 which belongs to the relevant row. When signal potential of the video signal is Vin, the potential Vgs actually held at both ends of the storage capacitor 3C is denoted by $Vin\times(1-Cs/(Cs+Cel+Csub))$. Therefore, the write gain is denoted by $Vgs/Vin=1-Cs/(Cs+Cel+Csub)$. As apparent from the expression, as Csub increases, the write gain Vgs/Vin comes closer to 1. In other words, the write gain can be adjusted by adjusting Csub. It is also possible to adjust white balance by adjusting Csub relatively in three RGB pixels.

In the case that the drain current of the driving transistor 3B is denoted by Ids, and the voltage to be corrected by mobility correction is denoted by $\Delta V$, a mobility correction time "t" is denoted by $(Cel+Csub)\times\Delta V/Ids$. Therefore, not only hold potential but also mobility correction time can be corrected by setting the auxiliary capacitor 3J. In general, as the pixel array becomes high fineness, aperture rate of the connection portion between the pixel circuit and the light emitting element becomes smaller, as a result, the Cel deceases. Then, the hold potential Vgs will be a value which is greatly lost from the signal potential Vin of the video signal when the auxiliary capacitor 3J is not arranged. Also from the reason, the auxiliary capacitor 3J is necessary.

Figure 6:
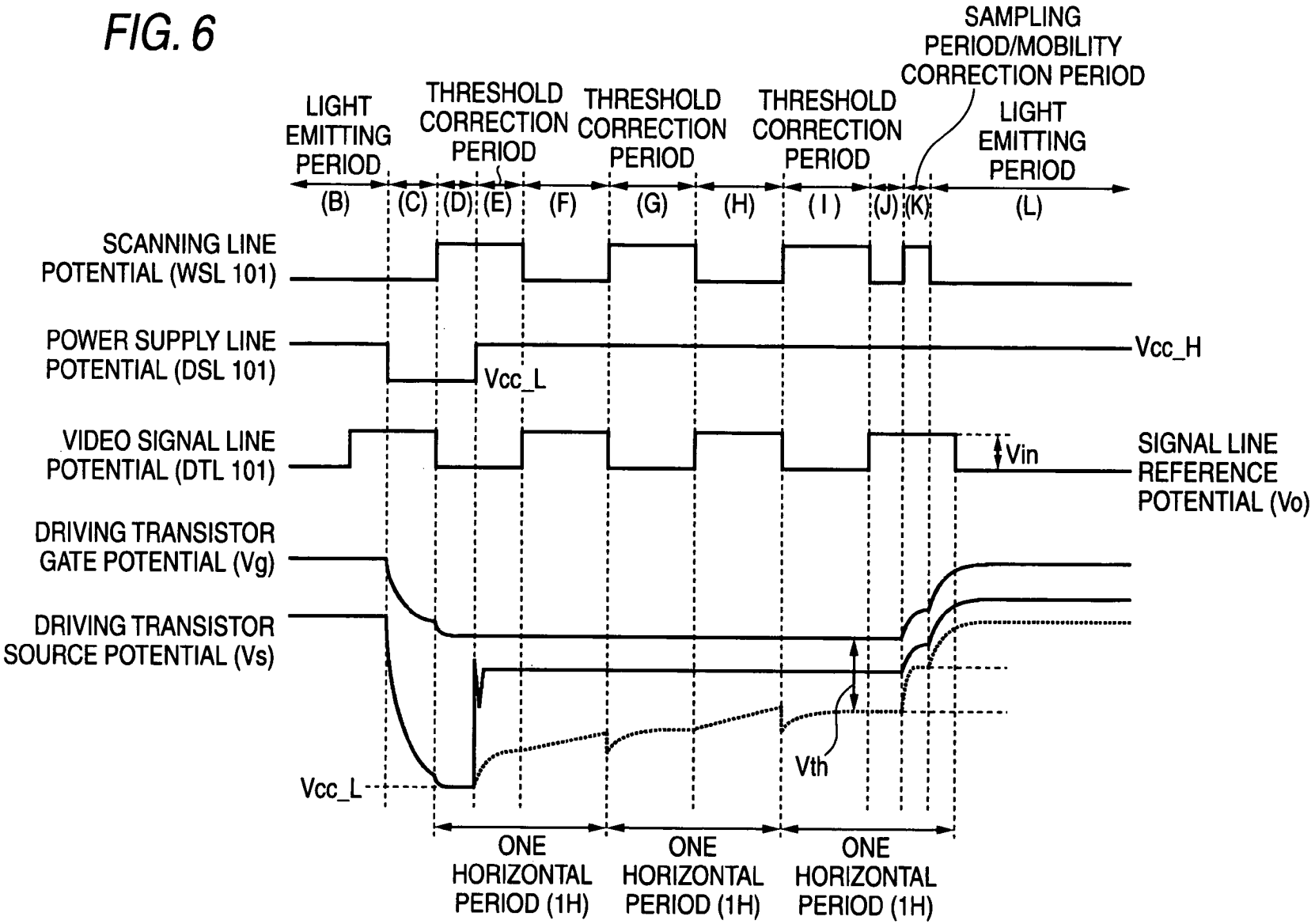
FIG. 6 is a timing chart for explaining operation of the precedent development example shown in FIG. 5.

FIG. 6 is a timing chart for explaining operation of a display device of a second precedent development shown in FIG. 5. For easy comprehension, the same notation as the timing chart of the first precedent development example is applied. A controversial point in the timing chart of FIG. 6 is a threshold voltage correction period E. At the beginning of the period E, capacitance coupling enters in the source "s" of the driving transistor 3B from the power supply line DSL101 through the auxiliary capacitor 3J, and the source potential Vs increases a lot. According to this, it is difficult to perform correction operation of the threshold voltage Vth. When the power supply line DSL101 is switched from low potential Vcc_L to high potential Vcc_H at the beginning of the threshold voltage correction period E, the potential variation is coupled with the source "s" of the driving transistor through the auxiliary capacitor 3J, the source potential Vs rises drastically in the positive direction. According to this, it is difficult to set voltage more than the threshold voltage Vth between the gate potential Vg and the source potential Vs and it is difficult to perform the threshold voltage correction operation normally.

Since the auxiliary capacitor 3J is arranged between the source "s" of the driving transistor 3B and the power supply line DSL101, when the power supply line DSL101 makes a transition from the low potential side to the high potential side at the beginning of the period E, the source "s" of the driving transistor 3B rises by $(Vcc_H-Vcc_L)\times(Csub/(Csub+Cel))$ due to the coupling by the auxiliary capacitor 3J. When the voltage Vgs between gate/source of the driving transistor 3B becomes smaller than the threshold voltage Vth, it is difficult to perform the threshold voltage correction operation. Therefore, luminance unevenness occurs due to the threshold voltage variations if nothing is done.

Figure 7:
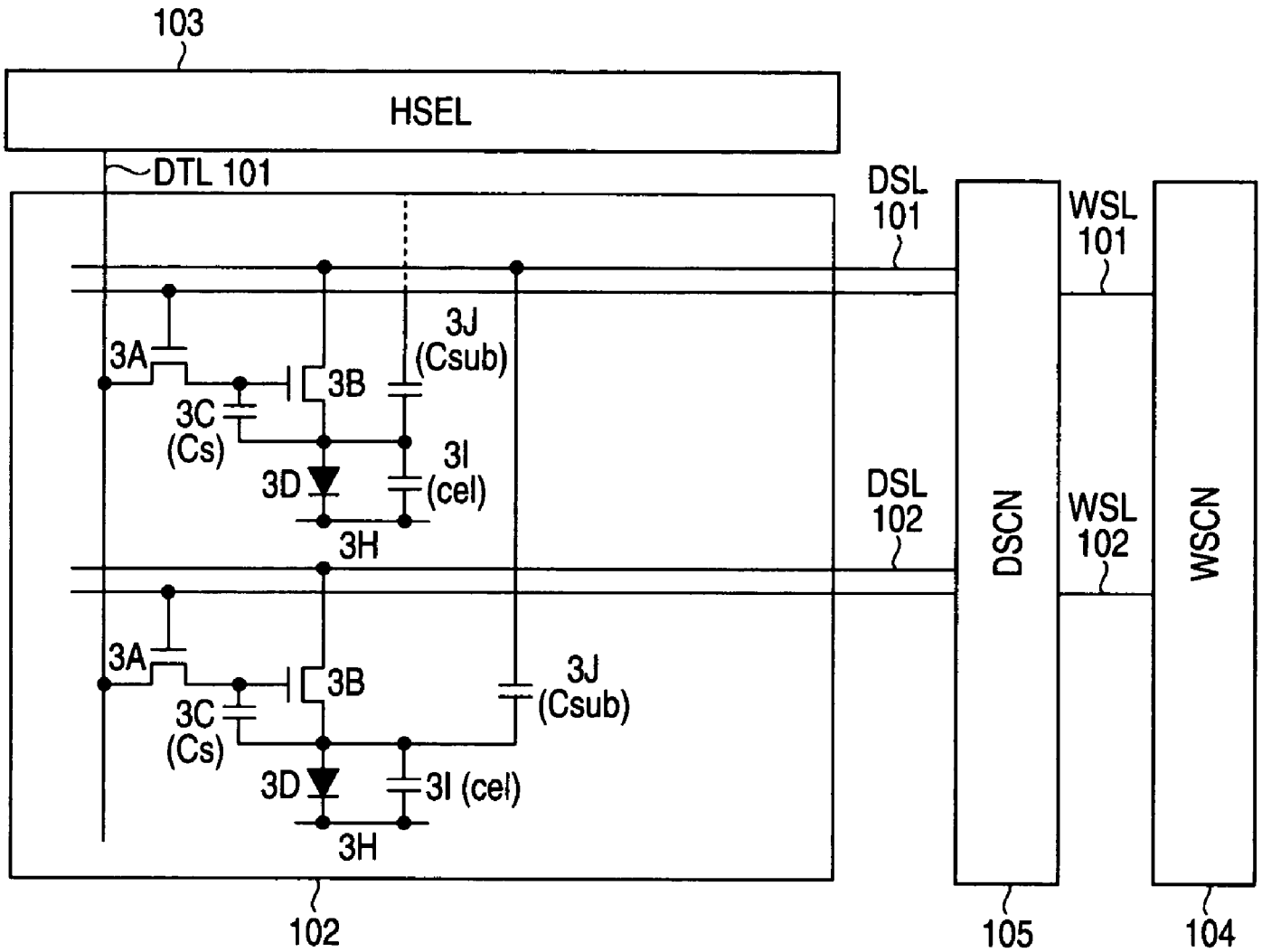
FIG. 7 is a circuit diagram showing a display device according the an embodiment of the invention.

FIG. 7 is a block diagram showing an embodiment of the display device relating to the invention. For easy comprehension, corresponding reference numerals are put to components corresponding to the example of precedent development shown in FIG. 5. In the embodiment of FIG. 7, a pixel corresponding to a scanning line WSL101 of the first line and a pixel corresponding to a scanning line WSL102 of the second row are shown by arranging up and down for easy comprehension. A point different from the example of precedent development shown in FIG. 5 is in a connection method of the auxiliary capacitor 3J. Specifically, when focusing attention to the pixel corresponding to the scanning line WSL102 of the second row, one end of the auxiliary capacitor 3J is connected to a source "s" of the driving transistor 3B, and the other end is connected to another power supply line DSL101 which belongs to the previous row from the power supply line DSL102 of the relevant row (namely, the second row). In the embodiment, the other end of the auxiliary capacitor 3J is connected to the power supply line DSL101 at the adjacent row, however, this is not limited to this. It is also possible to be connected to a power supply line which is not adjacent but further previous line.

Figure 8:
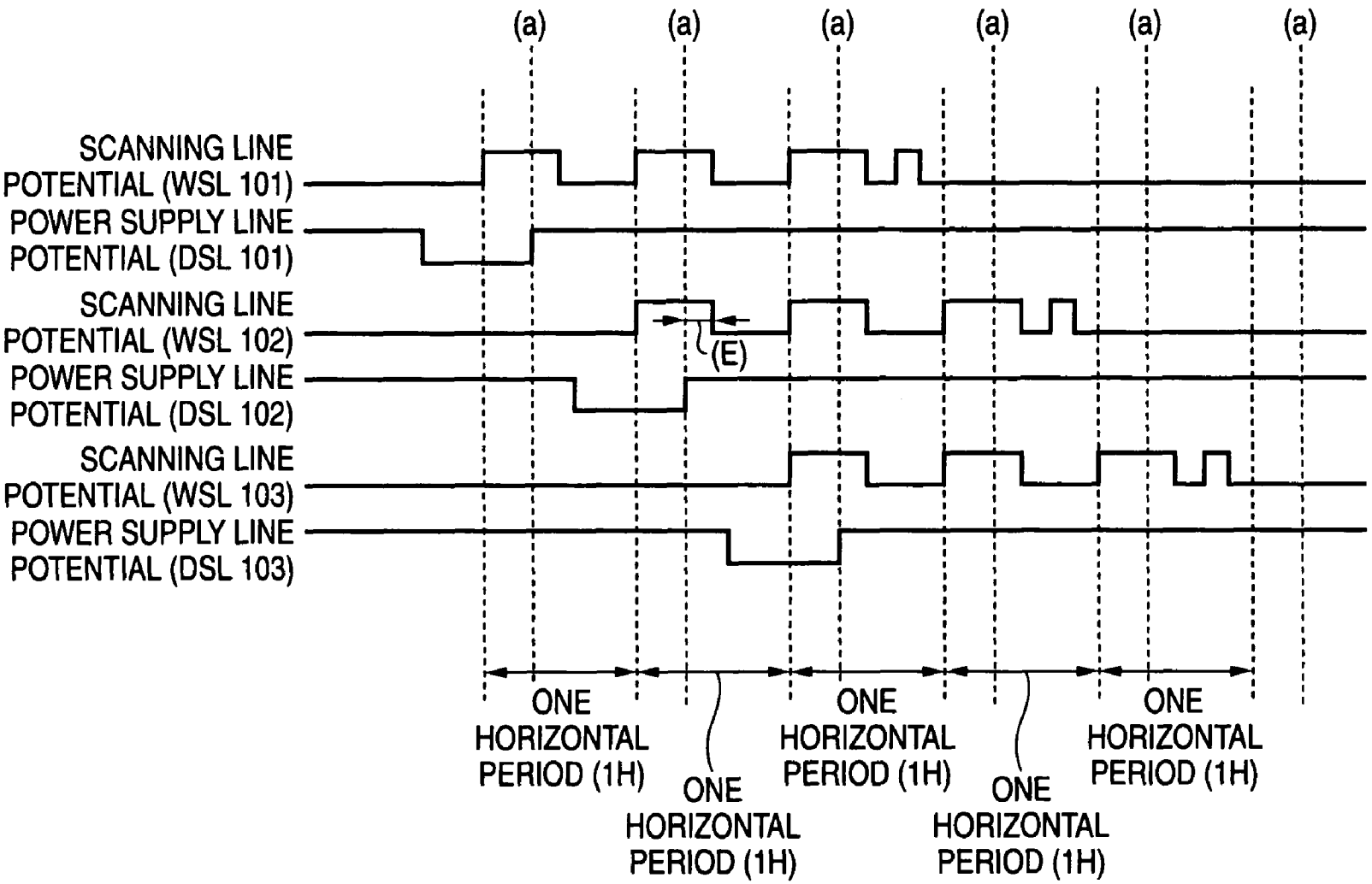
FIG. 8 is a timing chart for explaining operation of the display device according to the embodiment of the invention shown in FIG. 7.

FIG. 8 is a timing chart for explaining operation of the display device according to the embodiment of the invention shown in FIG. 7. Potential variations with respect to scanning line WSL101 to WSL103 which are from the first row to the third row as well as power supply lines DSL101 to DSL 103 which are from the first row to the third row are shown in time series. When the relevant row is set to the second row, the threshold voltage correction period E of pixels of the relevant row is shown as shown in the drawing. At the beginning of the threshold voltage correction period E, the power supply line DSL102 of the relevant row makes a transition from low potential to high potential. However, the power supply line DSL101 belonging to the previous row does not change at all and is maintained to be high potential. In the display device according to the embodiment of the invention, the auxiliary capacitor of the relevant stage is connected to the power supply line of the previous stage, therefore, the power supply line DSL101 does not vary at the beginning of the threshold voltage correction period E and no coupling enters. Therefore, the pixels of the relevant row can operate the threshold voltage correction operation at the first threshold voltage correction period (E) normally.

Figure 9:
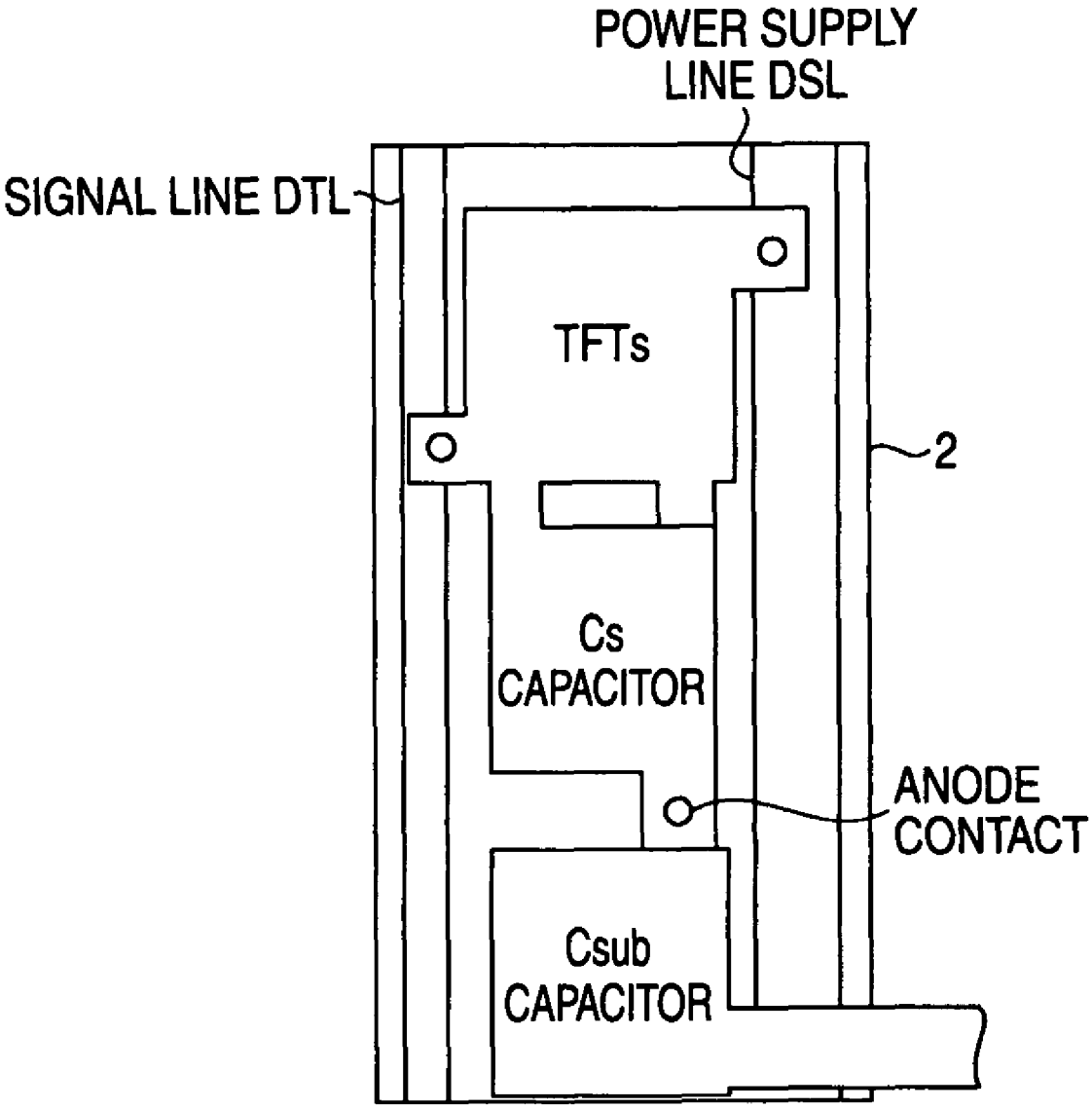
FIG. 9 is a schematic plan view showing a planar configuration of a pixel according to an embodiment of the invention.

FIG. 9 is a schematic plan view showing layout of a thin-film transistor TFT, a storage capacitor Cs and an auxiliary capacitor Csub forming each pixel 2. The sampling transistor 3A and the driving transistor 3B are formed by the thin-film transistor TFTs formed on an insulating substrate, the storage capacitor Cs and the auxiliary capacitor Csub are formed by a thin-film capacitor elements formed on the insulating substrate in the same way as the transistors. In the shown example, one terminal of the auxiliary capacitance Csub is connected to the storage capacitor Cs through an anode contact and the other terminal is connected to a prescribed fixed potential. In the embodiment, the fixed potential is the power supply line belonging to the previous stage. The power supply line is switched between the low potential and the high potential periodically, however, particularly in the time slot when pixels in the relevant stage operate, switching of the potential is not performed and the potential is regarded as the fixed potential.

Figure 10:
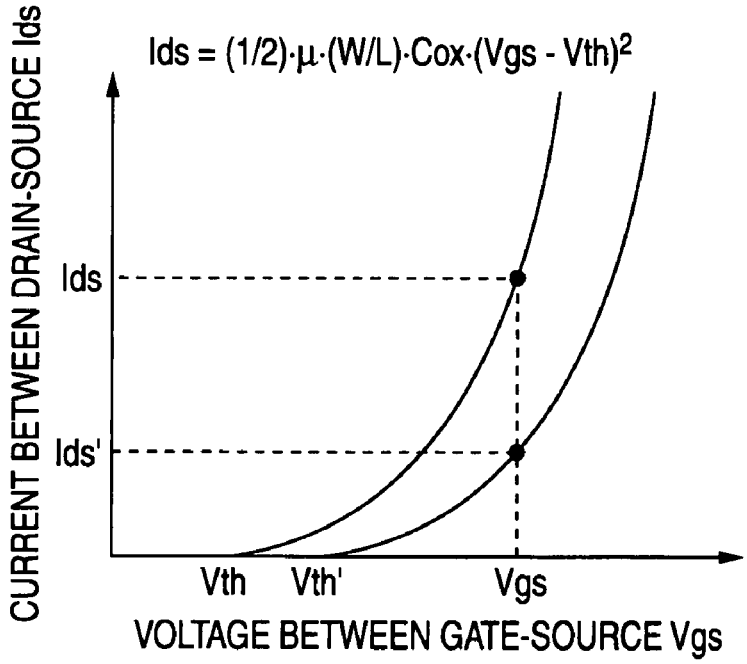
FIG. 10 is a graph for explaining operation of the display device according to an embodiment of the invention.

Lastly, as a reference, the threshold correction function, the mobility correction function and the bootstrap function are explained in detail. FIG. 10 is a graph showing current and voltage characteristics of the driving transistor. Particularly, the current Ids between drain/source when the driving transistor operates in a saturation region is denoted by Ids=(½)·μ·(W/L)·Cox·(Vgs−Vth)2. Here, "μ" denotes mobility, W denotes the gate width, L denotes the gate length and Cox denotes gate oxide film capacitance per unit area. As apparent from the expression of the transistor characteristic, when the threshold voltage Vth varies, the current Ids between drain/source varies even when the Vgs is fixed. In the pixel according to the embodiment of the invention, since the voltage Vgs between gate/source when light is emitted is denoted by Vin+Vth−ΔV as described above, when this is substituted for the above expression, the current Ids between drain/source is denoted by Ids=(½)·μ·(W/L)·Cox·(Vin−ΔV)2, and does not depend on the threshold Vth. As a result, when the threshold voltage Vth varies by manufacturing processes, the current Ids between drain/source does not vary, and the light emitting luminance of the organic EL device does not vary.

When any action is taken, the drive current corresponding to the Vgs becomes Ids when the threshold voltage is Vth as shown in FIG. 10, whereas drive current Ids' corresponding to the same gate voltage Vgs differs from Ids when the threshold voltage is Vth'.

Figure 11A:
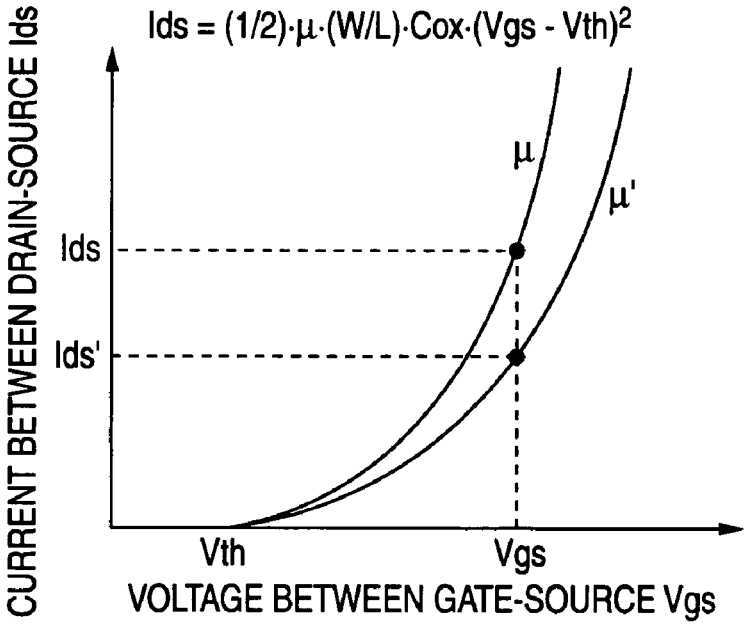
FIG. 11A is a graph for explaining operation in the same way.

FIG. 11A is also a graph showing current and voltage characteristics of the driving transistor. Concerning two driving transistors in which mobility differs, which are μ and μ', characteristic curves are shown respectively. As apparent from the graph, when the mobility differs as μ and μ', current between drain/source varies like Ids and Ids' even in the fixed Vgs.

Figure 11B:
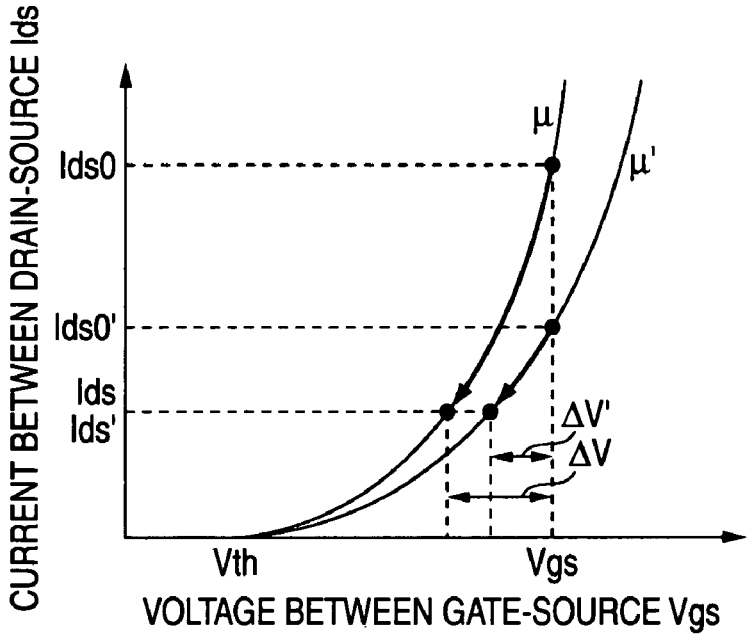
FIG. 11B is a graph for explaining operation in the same way.

FIG. 11B is a graph for explaining operation points of the driving transistor 3B at the time of mobility correction. By performing the above mobility correction with respect to the variation of mobility μ and μ' in manufacturing processes, optimum correction parameters ΔV and ΔV' are determined, and current between drain/source of the driving transistor Ids and Ids' are determined. When the mobility correction is not performed, in the case that the mobility differs as μ and μ' with respect to the voltage Vgs between gate/source, current between drain/source differs, which are Ids0 and Ids0' accordingly. In order to respond to this, by performing appropriate corrections ΔV and ΔV' with respect to the mobility μ and μ' respectively, current between drain/source becomes Ids and Ids', which are in the same level. As apparent from the graph of FIG. 11B, negative feedback is performed so that the correction amount ΔV increases when the mobility μ is high, whereas so that the correction amount ΔV' decreases when the mobility μ' is low.

Figure 12A:
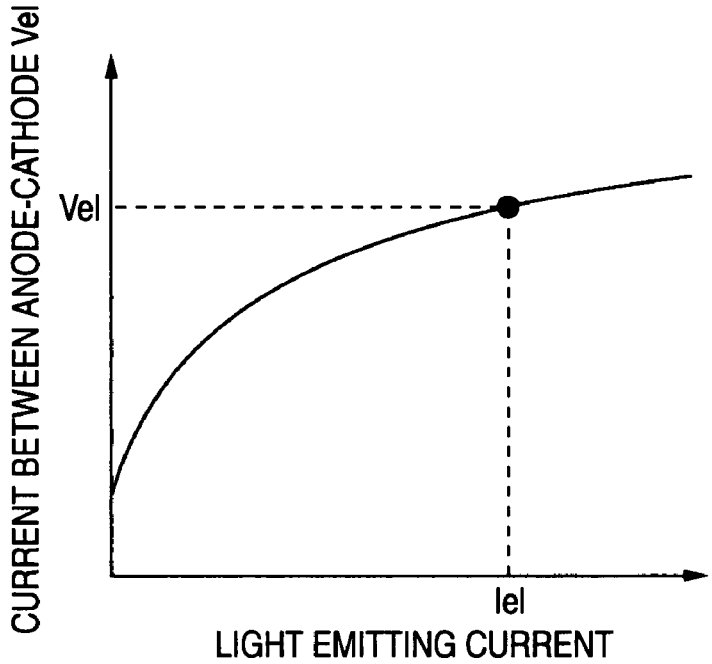
FIG. 12A is a graph for explaining operation in the same way.

FIG. 12A is a graph showing current/voltage characteristics of the light emitting element 3D formed by the organic EL device. When a current Iel flows in the light emitting element 3D, a voltage Vel between anode/cathode is uniquely determined. During the light emitting period, the scanning line WSL101 makes a transition to the low voltage side and the sampling transistor 3A is turned off, the anode of the light emitting element 3D rises for the amount of the voltage Vel between anode/cathode determined by the current Ids between drain/source of the driving transistor 3B.

Figure 12B:
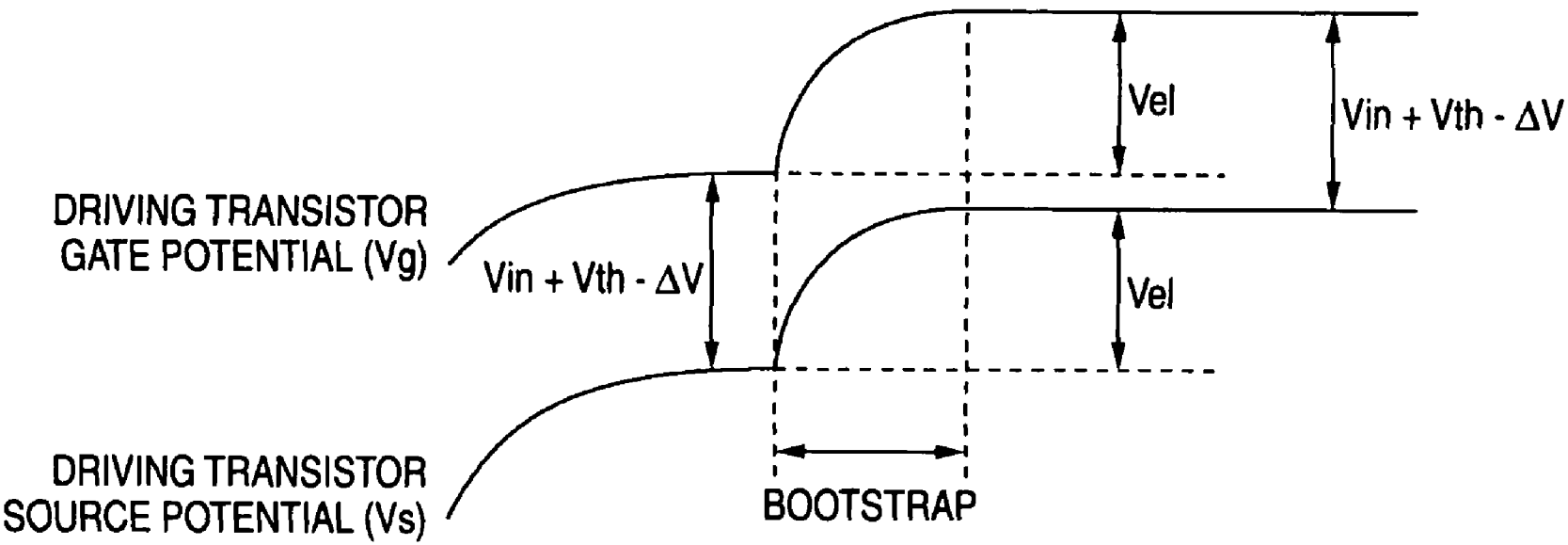
FIG. 12B is a waveform chart for explaining operation in the same way.

FIG. 12B is a graph showing potential variations of the gate voltage Vg and the source voltage Vs of the driving transistor 3B when the anode voltage of the light emitting element 3D rises. When the rising anode voltage of the light emitting element 3D is Vel, the source of the driving transistor 3B also rises for Vel, and the gate of the driving transistor 3B also rises for Vel by the bootstrap operation of the storage capacitor 3C. As a result, voltage Vgs=Vin+Vth−ΔV between gate/source of the driving transistor 3B which were held before the bootstrap will be held as it is after the bootstrap. Even when the anode voltage varies due to deterioration with time of the light emitting element 3D, the voltage between gate/source of the driving transistor 3B is maintained to be constant at Vin+Vth−ΔV.

Figure 13:
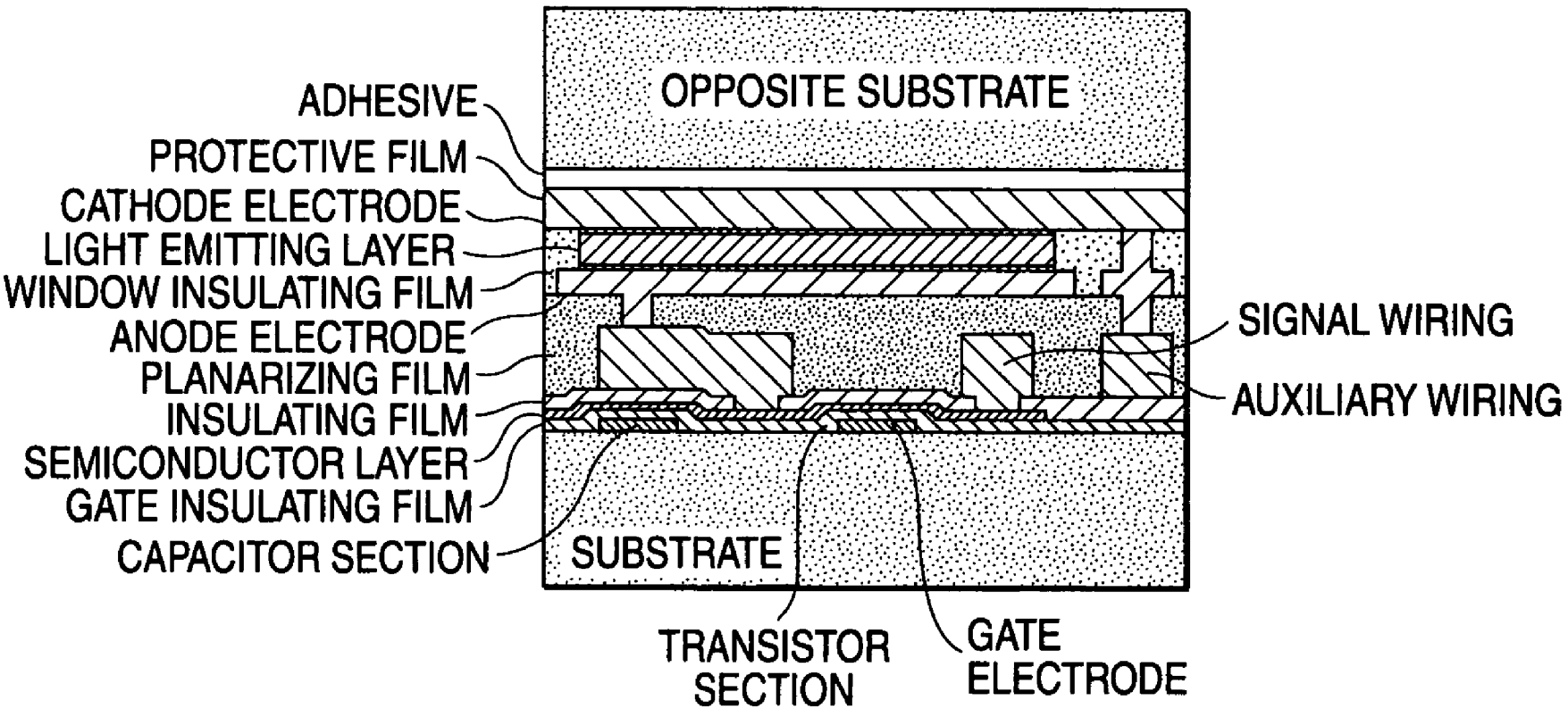
FIG. 13 is a cross-sectional view showing a device configuration of the display device according to an embodiment of the invention.

The display device according to an embodiment of the invention has a thin-film device structure as shown in FIG. 13. The drawing shows a schematic cross-sectional structure of a pixel formed on an insulating substrate. As shown in the drawing, the pixel includes a transistor section including plural thin-film transistors (in the drawing, one TFT is exemplified), a capacitor section such as a storage capacitor and a light emitting section such as an organic EL element. The transistor section and the capacitor section are formed on the substrate by a TFT process, and the light emitting section such as the organic EL element is stacked thereon. A transparent opposite substrate is adhered thereon through an adhesive to make a flat panel.

Figure 14:
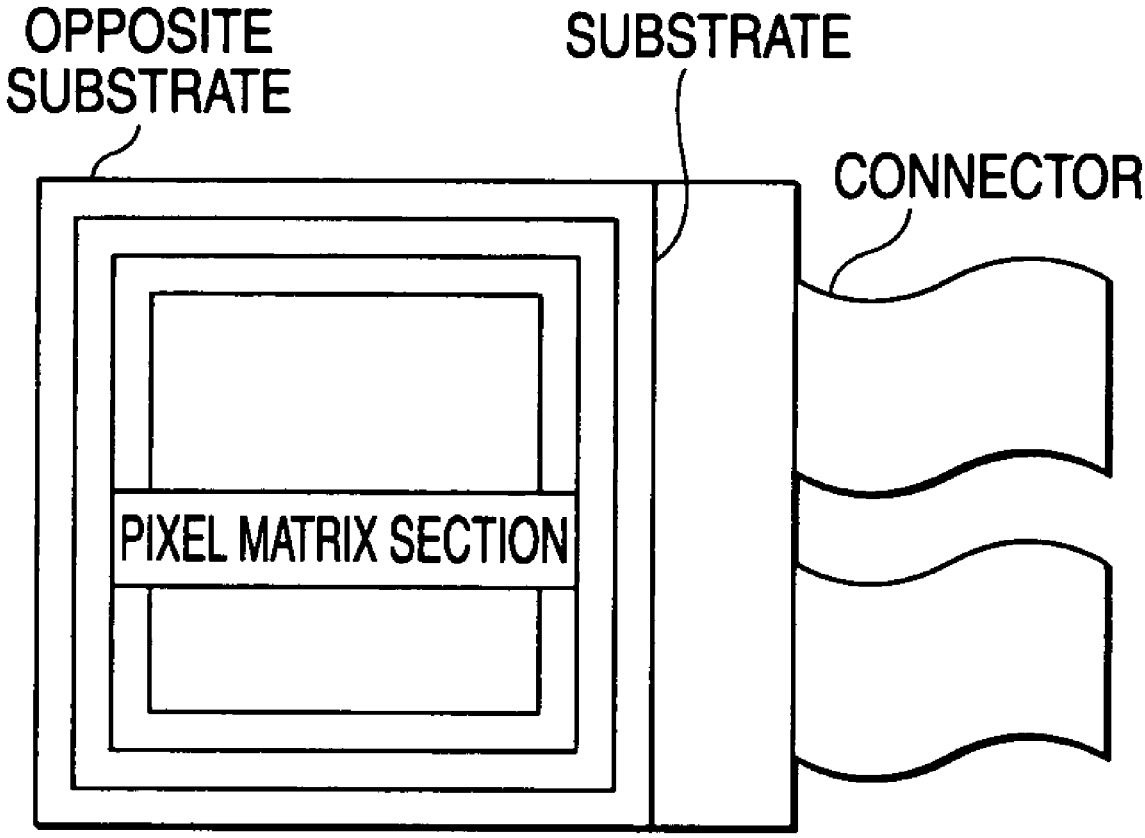
FIG. 14 is a plan view showing a module configuration of the display device according to an embodiment of the invention.

The display device according to an embodiment of the invention includes a flat-type device which has a module shape as shown in FIG. 14. For example, a pixel array unit in which a pixel having the organic EL element, thin-film transistors and a thin-film capacitor and the like are formed by integration in a matrix state is provided on the insulated substrate, an adhesive is arranged so as to surround the pixel array unit (pixel matrix unit), and an opposite substrate such as a glass is adhered to make a display module. The transparent opposite substrate may have a color filter, a protective film or a shielding film and the like if necessary. The display module may have an FPC (flexible print circuit) as a connector for inputting and outputting signals and the like to the pixel array unit from outside.

The display device according to an embodiment of the invention described above has a flat-panel shape and can be applied to displays of various fields of electronic equipment such as a digital camera, a notebook personal computer, a cellular phone, and a video camera, which display video signals inputted in the electronic equipment or generated in the electronic equipment as images or pictures. Hereinafter, examples of the electronic equipment to which the display device is applied will be shown.

Figure 15:
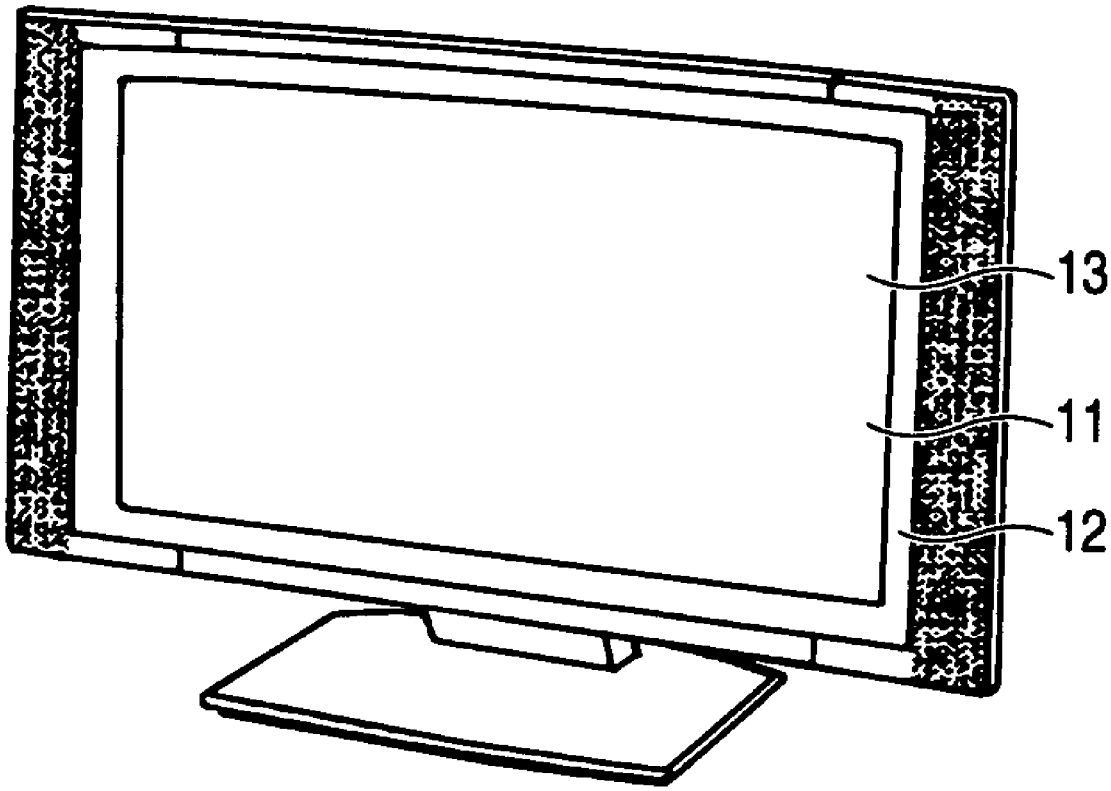
FIG. 15 is a perspective view showing a television set including the display device according to an embodiment of the invention.

FIG. 15 is a television to which an embodiment of the invention is applied, including a video display screen 11 having a front panel 12, a filter glass 13 and the like, which is fabricated by using the display device of the embodiment of the invention in the video display screen 11.

Figure 16:
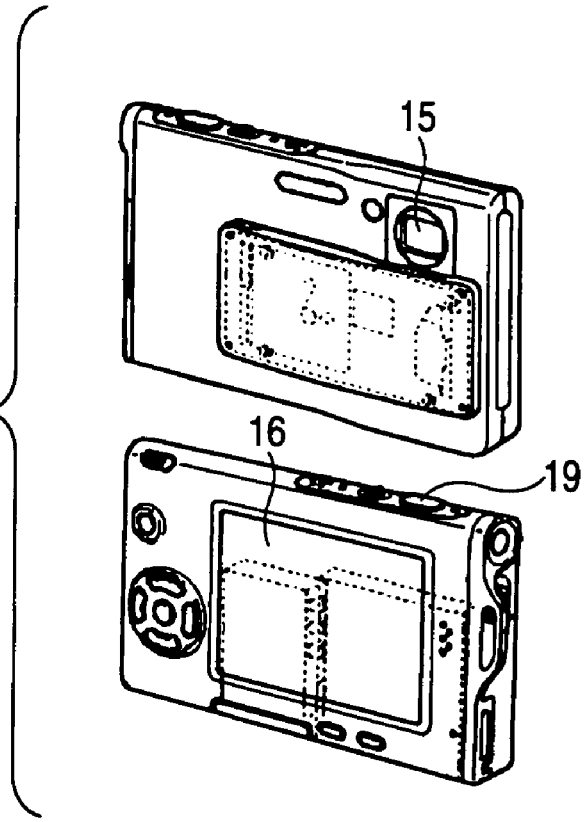
FIG. 16 is a perspective view showing a digital still camera including the display device according to an embodiment of the invention.

FIG. 16 is a digital camera to which an embodiment of the invention is applied, in which the upper drawing is a front view and the lower drawing is a rear view. The digital camera includes an imaging lens, light emitting section 15 for flash, a display section 16, a control switch, a menu switch, a shutter 19 and the like, which is fabricated by using the display device of the embodiment of the invention in the display section 16.

Figure 17:
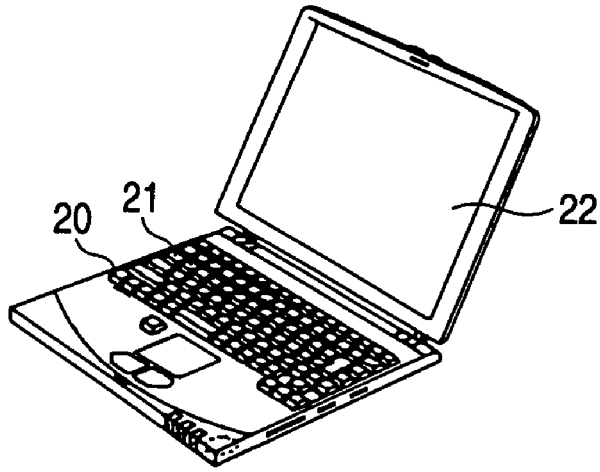
FIG. 17 is a perspective view showing a notebook personal computer including the display device according to an embodiment of the invention.

FIG. 17 is a notebook personal computer to which an embodiment of the invention is applied, including a keyboard 21 operated when inputting characters on a body 20 and a display section 22 on which pictures are displayed at a body cover, which is fabricated by using the display device of an embodiment of the invention in the display section 22.

Figure 18:
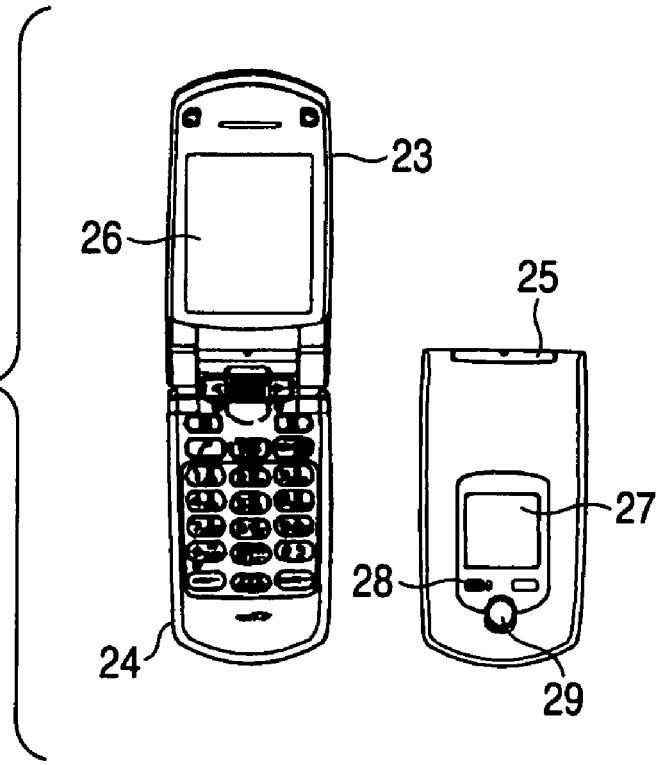
FIG. 18 is a schematic view showing a portable terminal device including the display device according to an embodiment of the invention.

FIG. 18 is a portable terminal device to which an embodiment of the invention is applied, in which the left shows an opened state and the right shows a shut state. The portable terminal device includes an upper casing 23, a lower casing 24, a connecting portion (in this case, a hinge portion) 25, a display 26, a sub-display 27, a picture light 28, a camera 29 and the like, which is fabricated by using the display device of the embodiment of the invention in the display 26 or in the sub-display 27.

Figure 19:
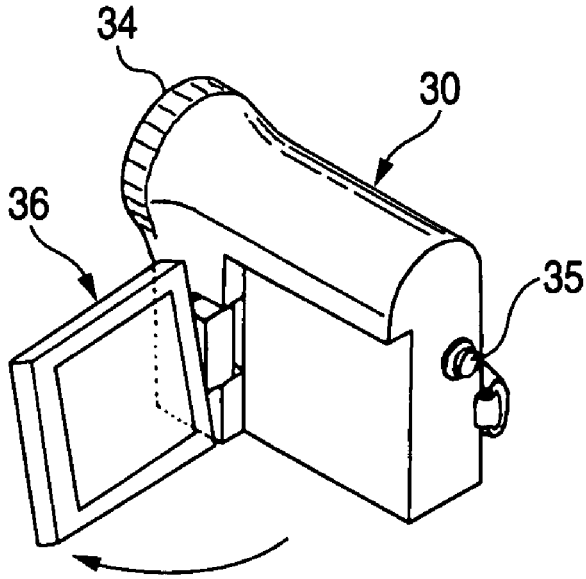
FIG. 19 is a perspective view showing a video camera including the display device according to an embodiment of the invention.

FIG. 19 is a video camera to which the embodiment of the invention is applied, including a body portion 30, a lens for taking subjects 34 at a side surface directed forward, a start/stop switch 35 at the time of taking, a monitor 36 and the like, which is fabricated by using the display device of the embodiment of the invention in the monitor 36.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising:

a pixel array unit and a driving unit which drives the pixel array unit, wherein the pixel array unit includes rows of scanning line, columns of signal lines, pixels in a matrix state arranged at portions where scanning lines and signal lines cross each other and power supply lines arranged corresponding to respective rows of pixels, wherein the driving unit includes a main scanner performing line-sequential scanning to pixels by each row by supplying a control signal to each scanning line sequentially, a power supply scanner supplying a power supply voltage which is switched to a first potential and a second potential to each power supply line so as to correspond to the line-sequential scanning, and a signal selector supplying a signal potential and a reference potential to be video signal to columns of signal lines so as to correspond to the line-sequential scanning, wherein the pixel includes a light emitting element, a sampling transistor, a driving transistor and a storage capacitor, wherein the sampling transistor is connected to the scanning line at a gate thereof, connected to the signal line at one of a source and a drain thereof, connected to a gate of the driving transistor at the other of the source and the drain, wherein the driving transistor is connected to the light emitting element at one of a source and a drain thereof, and connected to the power supply line at the other of the source and the drain thereof and in which the storage capacitor is connected between the source and the gate of the driving transistor, wherein the sampling transistor is turned on according to the control signal supplied from the scanning line and samples the signal potential supplied from the signal line to be stored in the storage capacitor, wherein the driving transistor receives supply of current from the power supply line at the first potential and allows drive current to flow in the light emitting element according to the stored signal potential, wherein the main scanner outputs the control signal to the scanning line at a timing of turning on the sampling transistor at a time slot when the signal line is at the signal potential, thereby writing the signal potential in the storage capacitor, as well as adds a correction to the signal potential, which is for mobility of the driving transistor, and wherein the pixel includes an auxiliary capacitor in order to increase write gain when storing the signal potential in the storage capacitor and in order to adjust time necessary for the correction of mobility.

2. The display device according to claim 1, wherein the auxiliary capacitor is connected to the source of the driving transistor at one end thereof and connected to another power supply line belonging to a previous row from the power supply line of the relevant row at the other end thereof.

3. The display device according to claim 1, wherein the main scanner turns off the sampling transistor and electrically disconnects the gate of the driving transistor from the signal line when the signal potential is stored in the storage capacitor, thereby allowing a gate potential to interlock with variations of a source potential of the driving transistor to maintain a voltage between the gate and the source to be constant.

4. The display device according to claim 1, wherein the main scanner outputs a control signal for turning on the sampling transistor at a time slot when the power supply line is at the first potential as well as the signal line is at the reference potential to perform a threshold voltage correction operation for storing a voltage corresponding to a threshold voltage of the driving transistor in the storage capacitor.

5. Electronic equipment, comprising the display device according to claim 1.

6. A display device comprising:

rows of scanning line, columns of signal lines, pixels in a matrix state arranged at portions where scanning lines and signal lines cross each other; and power supply lines arranged corresponding to respective rows of pixels, wherein the pixel includes a light emitting element, a sampling transistor, a driving transistor and a storage capacitor, wherein the sampling transistor is connected to the scanning line at a gate thereof, connected to the signal line at one of a source and a drain thereof, connected to a gate of the driving transistor at the other of the source and the drain, wherein the driving transistor is connected to the light emitting element at one of a source and a drain thereof, and connected to the power supply line at the other of the source and the drain thereof, wherein the storage capacitor is connected between the source and the gate of the driving transistor, and wherein an auxiliary capacitor is connected to the source of the driving transistor at one end thereof and connected to another power supply line belonging to a previous row from the power supply line of the relevant row at the other end thereof.

* * * * *